US011051613B1

(12) United States Patent
Gilbreath

(10) Patent No.: US 11,051,613 B1
(45) Date of Patent: Jul. 6, 2021

(54) SERVER CABINET

(71) Applicant: Moduflex LLC, Omaha, NE (US)

(72) Inventor: Taylor L. Gilbreath, Papillion, NE (US)

(73) Assignee: Moduflex LLC, Omaha, NE (US)

( * ) Notice: Subject to any disclaimer, the term of this patent is extended or adjusted under 35 U.S.C. 154(b) by 129 days.

(21) Appl. No.: 16/418,387

(22) Filed: May 21, 2019

Related U.S. Application Data

(63) Continuation-in-part of application No. 15/596,830, filed on May 16, 2017.

(60) Provisional application No. 62/674,744, filed on May 22, 2018, provisional application No. 62/749,217, filed on Oct. 23, 2018, provisional application No. 62/336,921, filed on May 16, 2016.

(51) Int. Cl.

| | |
|---|---|
| ***A47B 88/42*** | (2017.01) |
| ***A47B 46/00*** | (2006.01) |
| ***A47B 67/02*** | (2006.01) |
| ***A47B 88/403*** | (2017.01) |
| ***A47B 88/48*** | (2017.01) |
| ***E05B 65/46*** | (2017.01) |
| ***A47B 88/919*** | (2017.01) |

(52) U.S. Cl.
CPC ..... *A47B 67/02* (2013.01); *A47B 88/403* (2017.01); *A47B 88/48* (2017.01); *A47B 88/919* (2017.01); *E05B 65/46* (2013.01); *E05Y 2900/20* (2013.01)

(58) Field of Classification Search
CPC ..... A47B 67/02; A47B 88/403; A47B 88/48; A47B 88/919; A47B 88/42; E05B 65/46
See application file for complete search history.

(56) References Cited

U.S. PATENT DOCUMENTS

| | | | | |
|---|---|---|---|---|
| 1,469,359 A | | 10/1923 | Craw | |
| 1,570,207 A | | 1/1926 | Craw | |
| 1,625,480 A | | 4/1927 | Ludy | |
| 1,798,800 A | | 3/1931 | Macknight | |
| 1,994,044 A | | 3/1935 | Michelet | |
| 2,780,926 A | * | 2/1957 | Sharpe | F25D 25/024 62/382 |
| 2,895,782 A | | 7/1959 | Fragale | |
| 3,087,764 A | | 4/1963 | Schless, Jr. | |

(Continued)

OTHER PUBLICATIONS http://www.spacesaver.com/products/nurse-server-corestor/—May 21, 2019.

*Primary Examiner* — Kimberley S Wright
(74) *Attorney, Agent, or Firm* — Erik M. Antonson; Advent, LLP

(57) ABSTRACT

A cabinet can include a housing that defines at least a first interior space and a second interior space. The first interior space and the second interior space can be separated from one another by at least one sealed partition. The first interior space can be configured to support a basket assembly, and the second interior space can be configured to support a hamper assembly. The cabinet can also include a door that provides access to the first interior space and/or the second interior space. The cabinet can include a base cabinet housing and a pull-out cabinet insert that can extend from the base cabinet housing to provide access to the basket assembly. The cabinet can include a slide out support mechanism to extend the pull-out cabinet insert from the housing, and a cable management device connected to the pull-out cabinet insert to route wiring to the cabinet insert.

9 Claims, 24 Drawing Sheets

(56) References Cited

U.S. PATENT DOCUMENTS

| | | | | |
|---|---|---|---|---|
| 3,689,128 | A * | 9/1972 | Andreini | A47B 49/004 312/287 |
| 3,807,826 | A | 4/1974 | Peckenpaugh | |
| D325,829 | S | 5/1992 | Cury | |
| 5,238,749 | A | 8/1993 | Cueman et al. | |
| 5,294,009 | A | 3/1994 | Maurer et al. | |
| 6,062,416 | A | 5/2000 | Smillie | |
| 6,076,906 | A * | 6/2000 | Royal | A47B 46/00 312/223.1 |
| D431,130 | S | 9/2000 | Thompson et al. | |
| 6,185,098 | B1 | 2/2001 | Benavides | |
| 6,619,770 | B1 | 9/2003 | Drab et al. | |
| 7,562,543 | B2 | 7/2009 | Kendall et al. | |
| 8,160,741 | B1 | 4/2012 | Shoenfeld | |
| D663,134 | S | 7/2012 | Wu | |
| 8,917,513 | B1 | 12/2014 | Hazzard | |
| 9,019,706 | B2 | 4/2015 | Ning et al. | |
| 9,475,110 | B2 | 10/2016 | Derry et al. | |
| D801,291 | S | 10/2017 | Gerber et al. | |
| 9,872,562 | B2 | 1/2018 | Brunner | |
| D812,025 | S | 3/2018 | Cagliani et al. | |
| 10,028,582 | B2 | 7/2018 | Nilsson et al. | |
| 10,039,212 | B2 | 7/2018 | Slessman | |
| 2003/0019165 | A1 | 1/2003 | Gallant et al. | |
| 2004/0232810 | A1 * | 11/2004 | Kreyenkamp | A47B 88/48 312/322 |
| 2005/0133473 | A1 | 6/2005 | Lesperance | |
| 2007/0151301 | A1 | 7/2007 | Kendall et al. | |
| 2007/0151302 | A1 | 7/2007 | Kendall et al. | |
| 2007/0200471 | A1 | 8/2007 | Boone | |
| 2007/0210679 | A1 | 9/2007 | Adducci et al. | |
| 2007/0289225 | A1 | 12/2007 | Kern et al. | |
| 2010/0066045 | A1 | 3/2010 | Presnell | |
| 2010/0307186 | A1 * | 12/2010 | Kwon | F25D 23/028 62/407 |
| 2015/0376914 | A1 | 12/2015 | Derry et al. | |
| 2016/0128470 | A1 * | 5/2016 | Chen | A47B 88/43 312/348.4 |
| 2016/0128474 | A1 * | 5/2016 | Chen | A47B 88/969 312/333 |
| 2017/0099945 | A1 | 4/2017 | Meads | |

* cited by examiner

SERVER CABINET

CROSS-REFERENCE TO RELATED APPLICATIONS

The present application claims the benefit under 35 U.S.C. § 119(e) of U.S. Provisional Application Ser. No. 62/674,744, filed May 22, 2018, and titled "SERVER CABINET" and U.S. Provisional Application Ser. No. 62/749,217, filed Oct. 23, 2018, and titled "SERVER CABINET." The present application is also a continuation-in-part under 35 U.S.C. § 120 of U.S. patent application Ser. No. 15/596,830, filed May 16, 2017, and titled "SERVER CABINET," which claims priority under 35 U.S.C. § 119(e) of U.S. Provisional Application Ser. No. 62/336,921, filed May 16, 2016, and titled "SERVER CABINET." U.S. patent application Ser. No. 15/596,830 and U.S. Provisional Application Ser. Nos. 62/336,921; 62/674,744; and 62/749,217 are herein incorporated by reference in their entireties.

BACKGROUND

Generally, a cabinet is a cupboard with drawers or shelves for storing or displaying articles.

DRAWINGS

The Detailed Description is described with reference to the accompanying figures. The use of the same reference numbers in different instances in the description and the figures may indicate similar or identical items.

DETAILED DESCRIPTION

Figure 1:
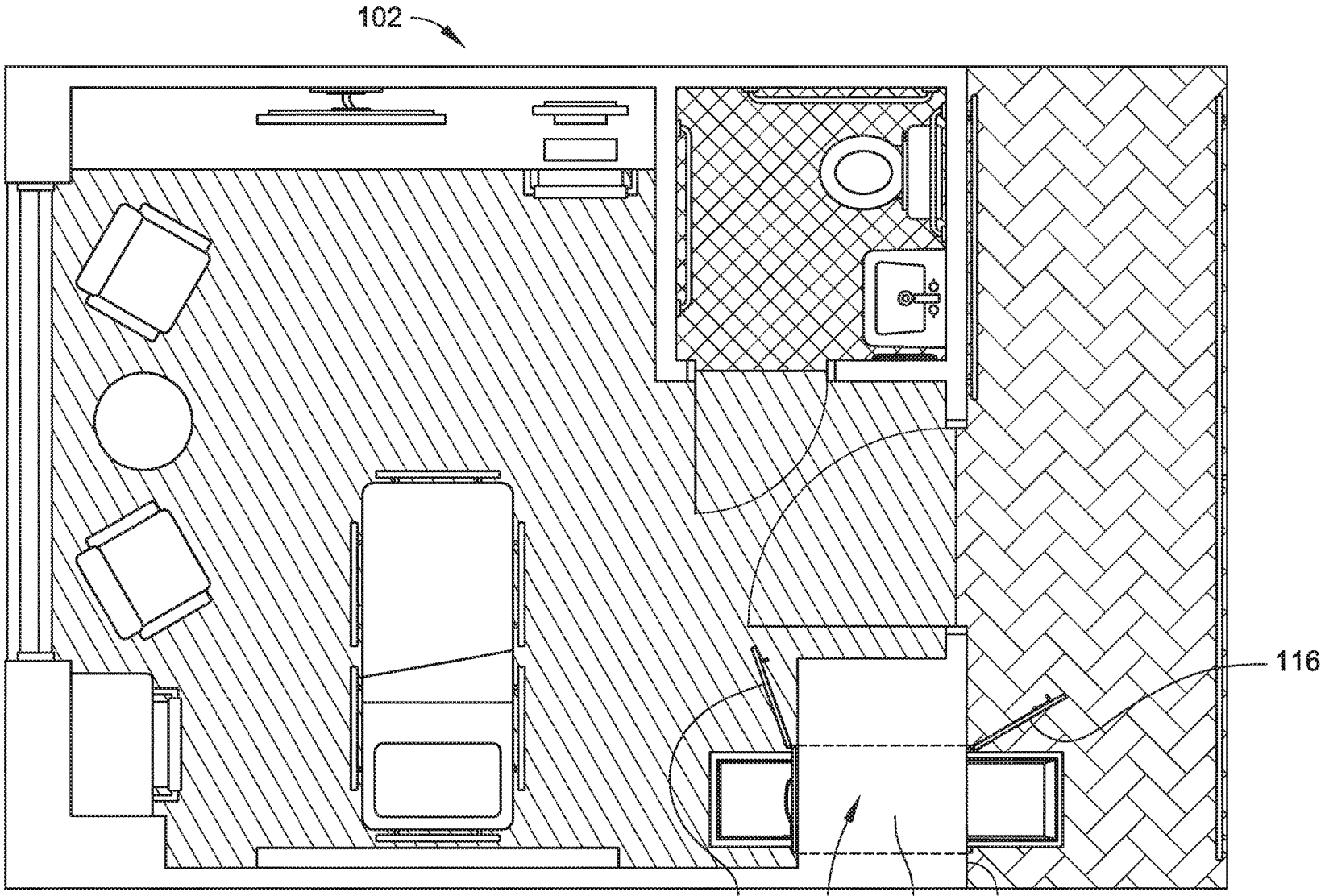
FIG. 1 is an environmental plan view illustrating a patient room (e.g., of a hospital) including a cabinet, such as a cabinet illustrated in FIGS. 2 through 8, in accordance with example embodiments of the present disclosure.
Figure 2:
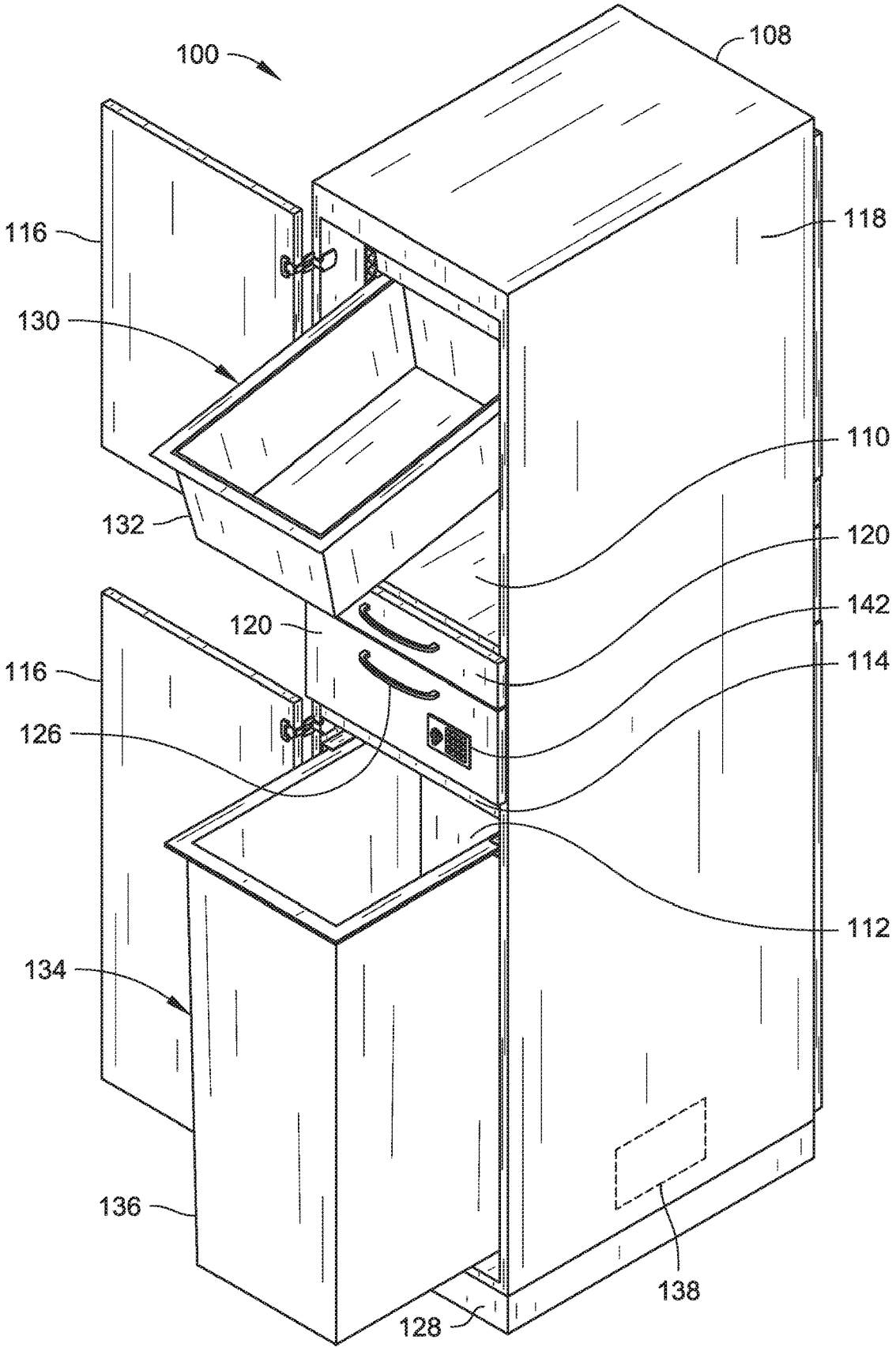
FIG. 2 is an isometric view illustrating a cabinet in accordance with example embodiments of the present disclosure.
Figure 3:
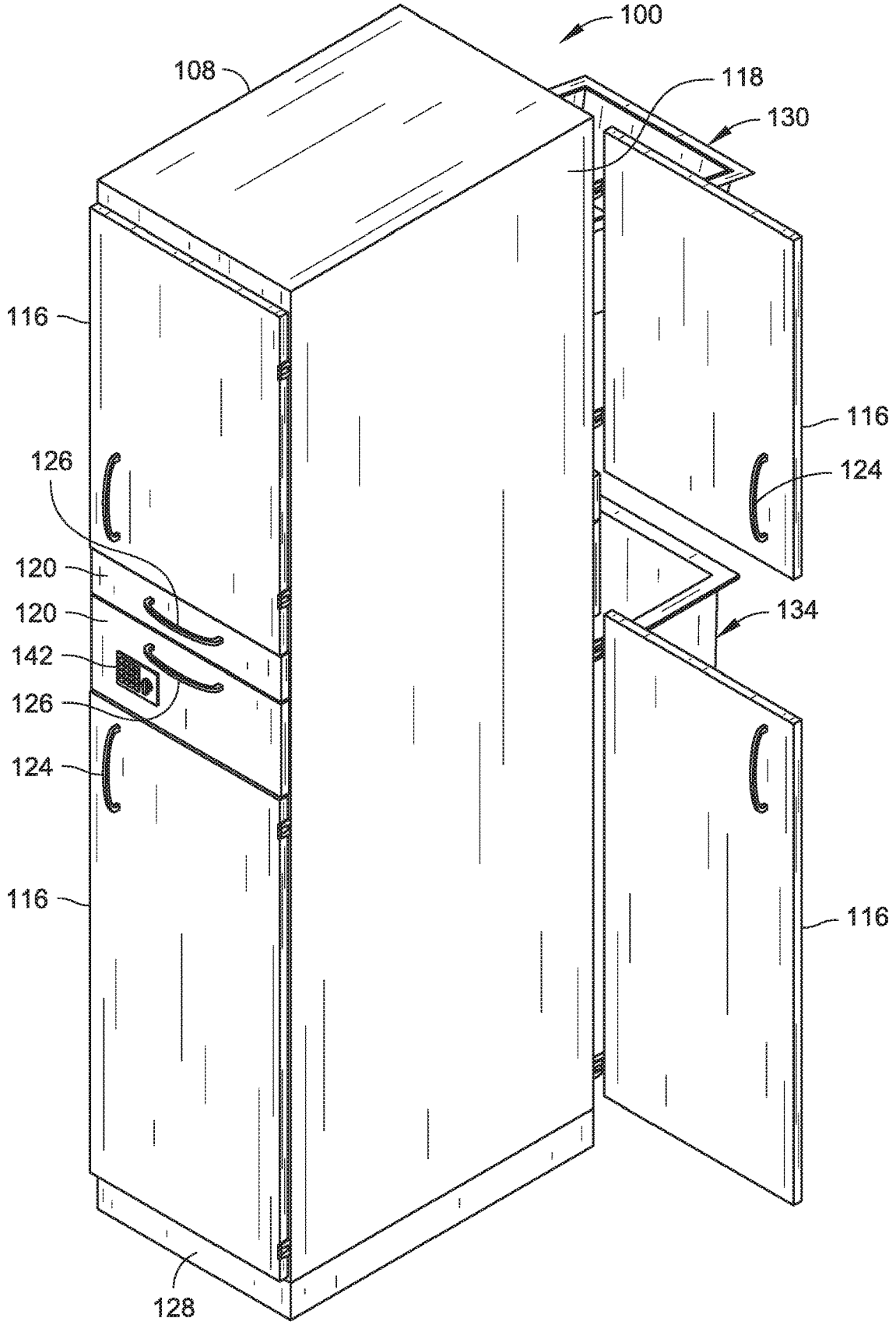
FIG. 3 is another isometric view of the cabinet illustrated in FIG. 2.
Figure 4:
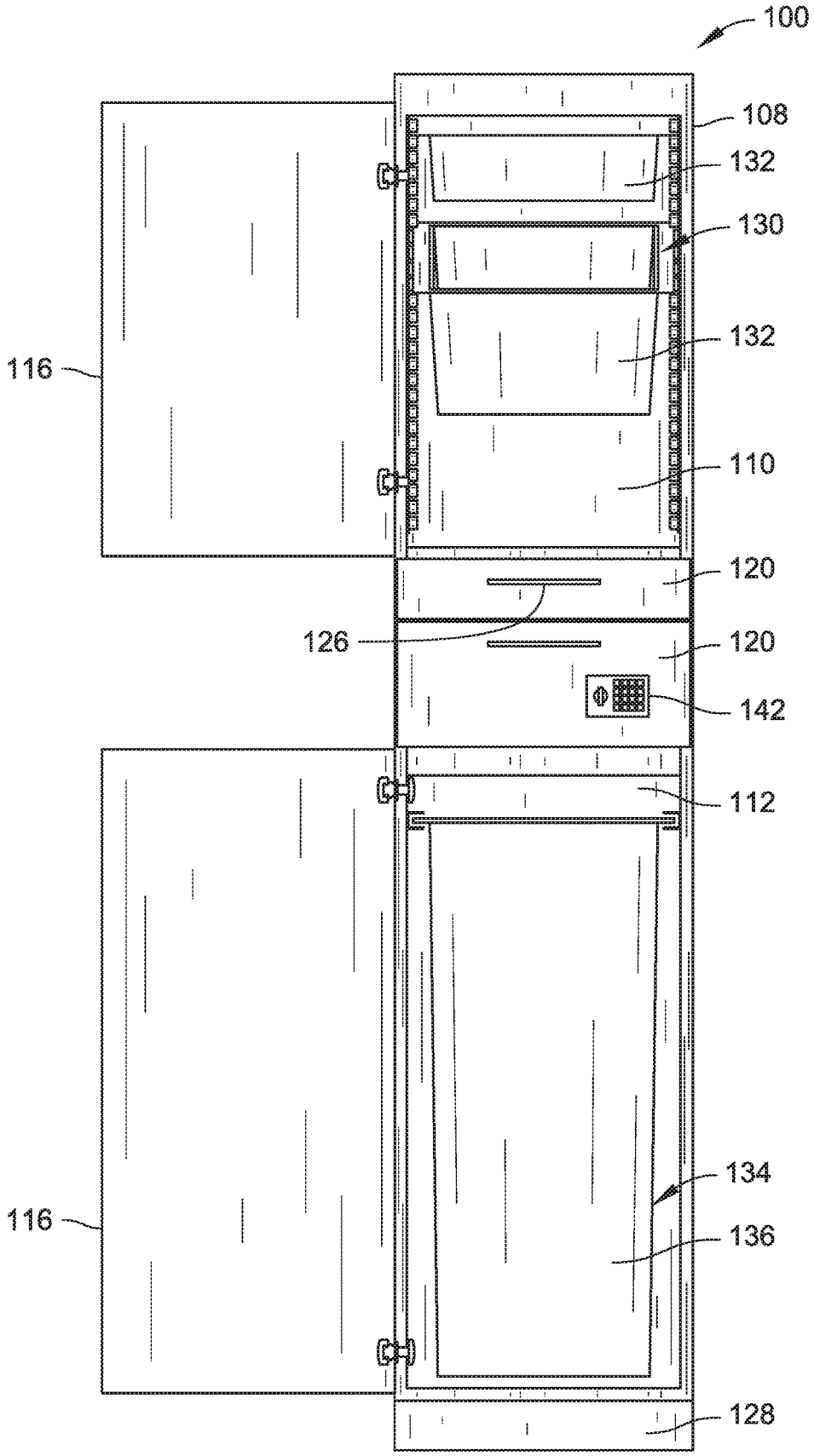
FIG. 4 is an elevation view of the cabinet illustrated in FIG. 2.
Figure 5:
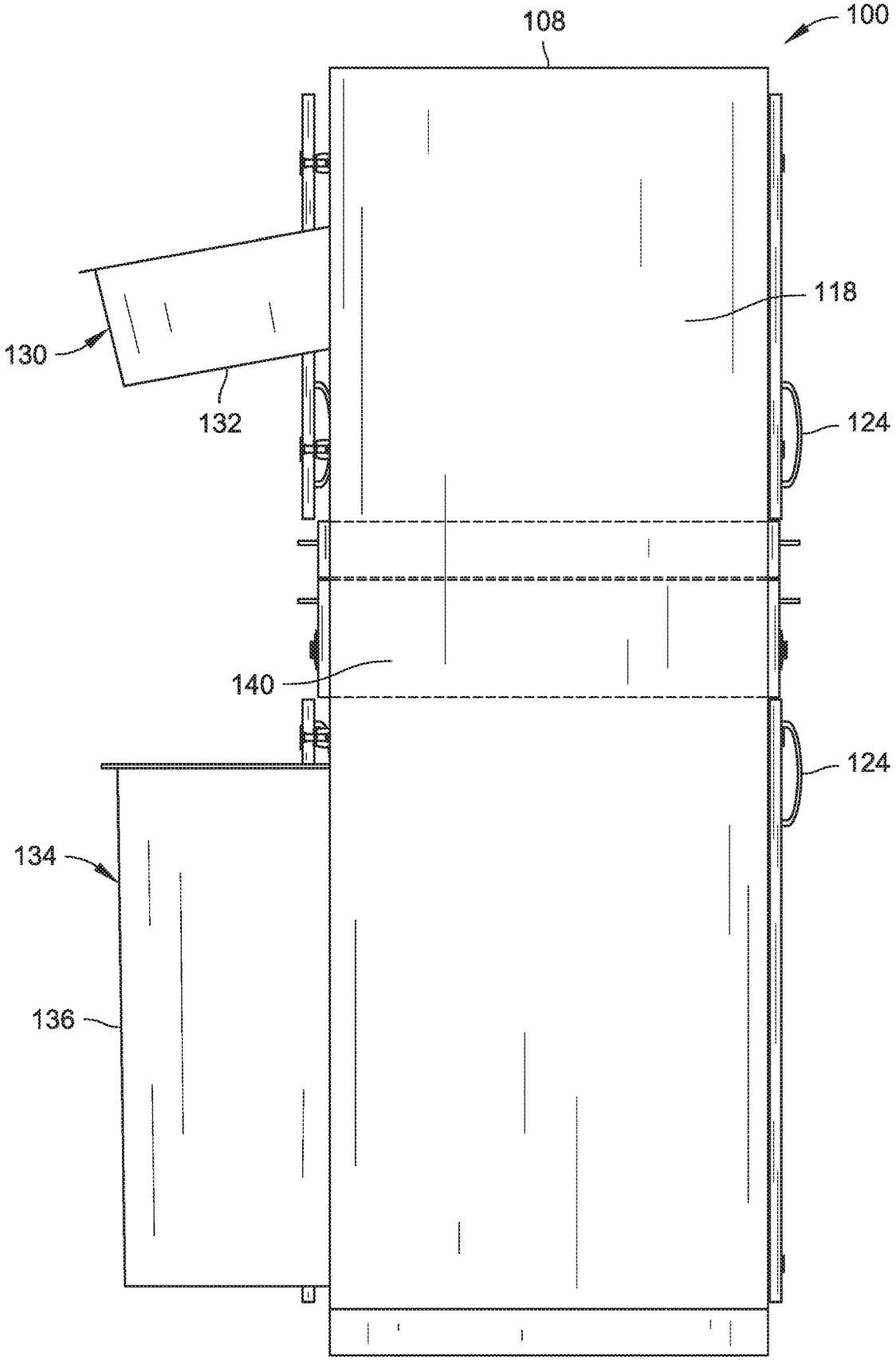
FIG. 5 is another elevation view of the cabinet illustrated in FIG. 2.
Figure 6:
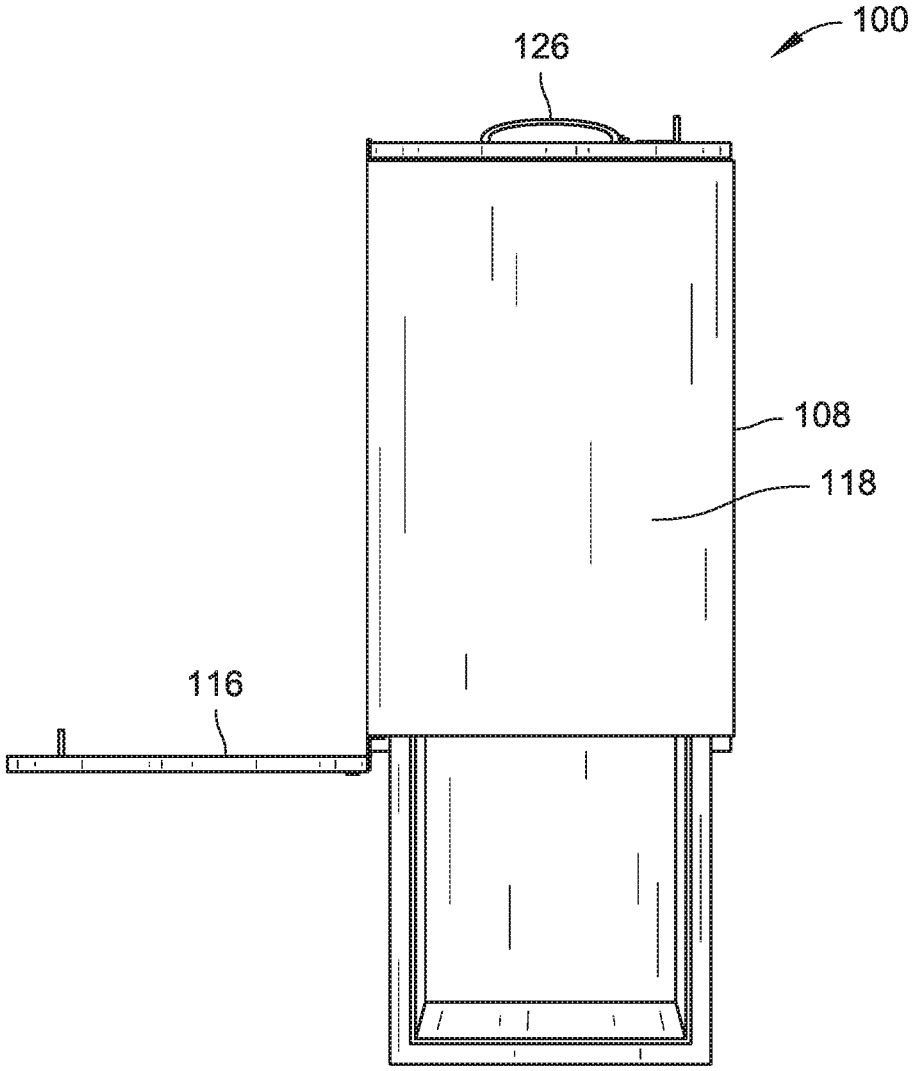
FIG. 6 is a top plan view of the cabinet illustrated in FIG. 2.
Figure 7:
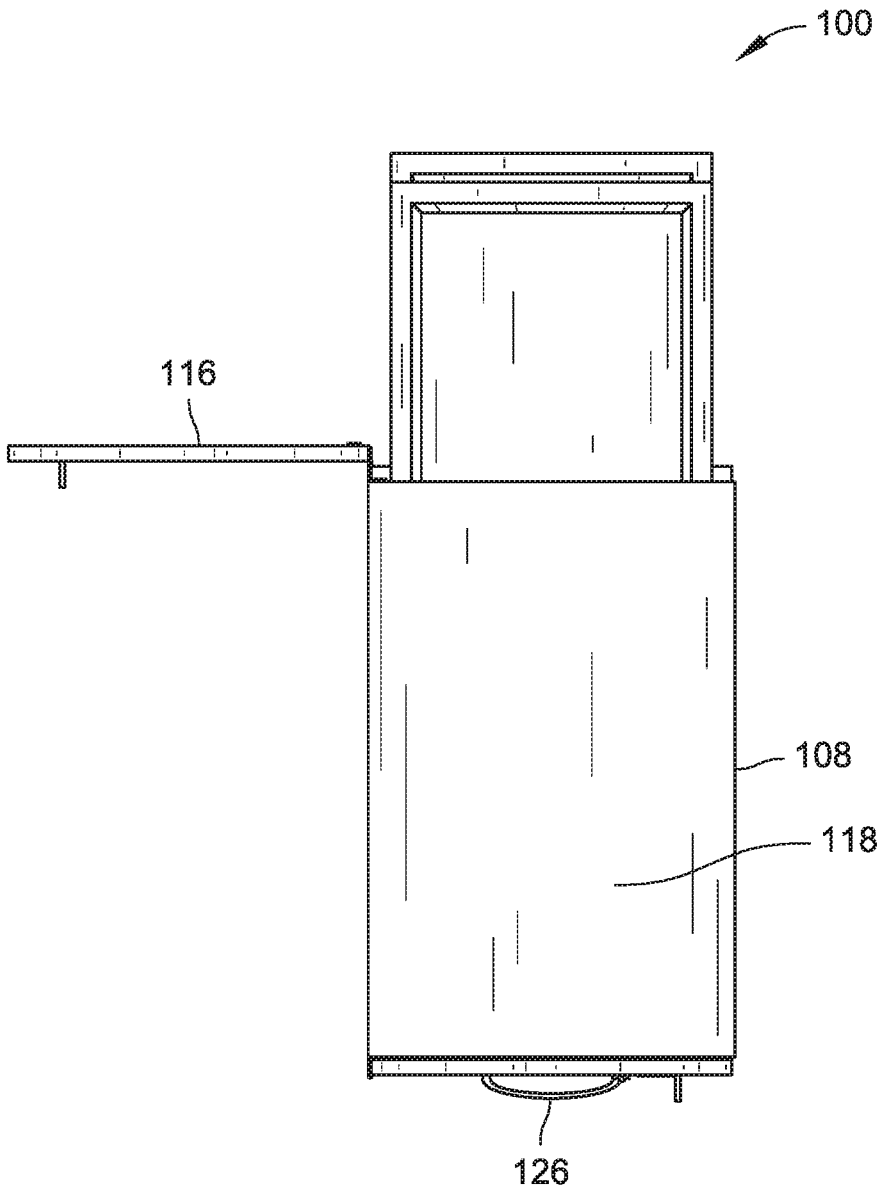
FIG. 7 is another top plan view of the cabinet illustrated in FIG. 2.

Cabinets to be installed in institutional spaces (e.g., hospitals) are typically constructed of simple laminate and generally do not include built-in organizational components to facilitate proper and efficient storage of goods, such as medical supplies. For example, cabinets installed in hospital settings are typically built-in millwork servers. Such cabinetry may not work well with central supply methodologies, as they can be difficult to inventory, restock, label, and so forth. Further, there may be little or no security provided for the contents in these cabinets.

Referring generally to FIGS. 1 through 24, cabinets 100 in accordance with the present disclosure can be used to facilitate an exchange system, where supplies, linen, and other goods can be changed after each patient in a room 102 associated with a cabinet 100 is discharged. Such cabinets 100 can allow for efficient inventorying, restocking, and/or labeling of goods in the cabinet 100 with a minimum amount of foot traffic and patient disruption. The cabinets 100 can be configured as modular pass-through servers that provide flexibility to meet the needs of patients, staff, and facilities. These cabinets 100 can provide a "turnkey" solution for facilities (e.g., when compared with built-in millwork servers). In some embodiments, a cabinet 100 can be "kitted" and delivered and placed into a cavity 104 (e.g., at each patient room 102). Final installation and/or placement of a cabinet 100 can be performed by a vendor providing the cabinet 100 or by a general contractor on site. Trim work 106 around the exterior of a cabinet 100 (e.g., on corridor and/or patient room sides) may be provided by a manufacturer or supplied and installed by a general contractor on the jobsite.

As described herein, cabinets 100 can be used for applications including, but not necessarily limited to: new hospital construction, new patient-room renovations and/or additions, emergency department renovations and/or additions, intensive care unit (ICU) department renovations and/or additions, labor and delivery renovations and/or additions, and so forth. The cabinets 100 described herein can facilitate dynamic workflow, organization, and ease of use for storing supplies, linens, and/or medications stocked at a patient-room level for nursing staff and supply departments. The cabinets 100 can improve the overall experience of patients, the efficiency of staff, the control of hospital acquired infections (HAIs), and so forth. In some embodiments, a cabinet 100 may be a pass-through cabinet. In some embodiments, a cabinet 100 may be a single-sided cabinet. In some embodiments, a cabinet 100 may be mobile (e.g., supported on wheels).

The cabinets 100 can be pre-fabricated and provided ready-to-install. The cabinets 100 can provide pass-through, non-pass-through, and ninety (90) degree pull-out units. As more fully described below, basket systems with bidirectional bins that pull out and tilt down into both the corridor and the patient room can provide accessible, hands-free, vertical storage. The bins and basket system can be interchangeable on-site, and can be used with adjustable dividers, label holders, and the like. A bidirectional locking medication drawer can be included that pulls out into both the corridor (for stocking) and the patient room (for retrieval). A writing surface can also be provided and used as a medication and/or documentation shelf. An interior space can be provided for receiving and storing soiled linen, trash carts, heavy-duty metal hoppers, and other storage devices. In this manner, carts and/or hoppers can be hidden behind doors, and soiled materials can be disposed of from the hospital corridor. The cabinets 100 can also be used with locking systems, which can interface with current hospital security systems (e.g., in a plug-and-play manner) and may include one or more wireless keypads or other data entry devices.

In some embodiments, a cabinet 100 can be configured as a server (e.g., a nurse server, a patient server, etc.). A cabinet 100 can include a housing 108 that defines at least a first interior space 110 and a second interior space 112, where the first interior space 110 is separated from the second interior space 112 by at least one sealed partition 114. For example, a sealed partition 114 can be three-quarter inch (¾") industrial grade particle board edged (e.g., on all sides) with polyvinyl chloride (PVC) edge band, and sealed with healthcare grade silicone caulk. The edge band may range from between about one-half millimeter (0.5 mm) to about five millimeters (5 mm). For example, the edge band may be one millimeter (1 mm) PVC edge band, three millimeter (3 mm) PVC edge band, and so forth.

In embodiments, the cabinet may be constructed using a wood material, a wood-based material (e.g., a laminate material), a composite material, and so on. For example, the housing 108, one or more cabinet doors 116, and/or one or more drawers 120 can include a thermofoil surface, a fire-rated laminate, and so forth. In some embodiments, the housing 108, the cabinet doors 116, and/or the drawers 120 can be formed from a high-pressure laminate or a thermofused laminate covering a particle board core. In some embodiments, the housing 108 of the cabinet 100 and/or the cabinet doors 116 may be constructed using a metal material, such as steel (e.g., powder-coated steel), which may be fourteen (14) gauge, eighteen (18) gauge, twenty (20) gauge, and so forth. However, steel is provided by way of example and is not meant to limit the present disclosure. In other embodiments, the cabinet 100 and/or the cabinet doors 116 may be constructed using one or more other metal materials, such as aluminum. The exterior 118 of the cabinet 100 (e.g., including doors 116, drawers 120, and so forth) may also be constructed using a metal material such as power-coated steel.

Figure 8:
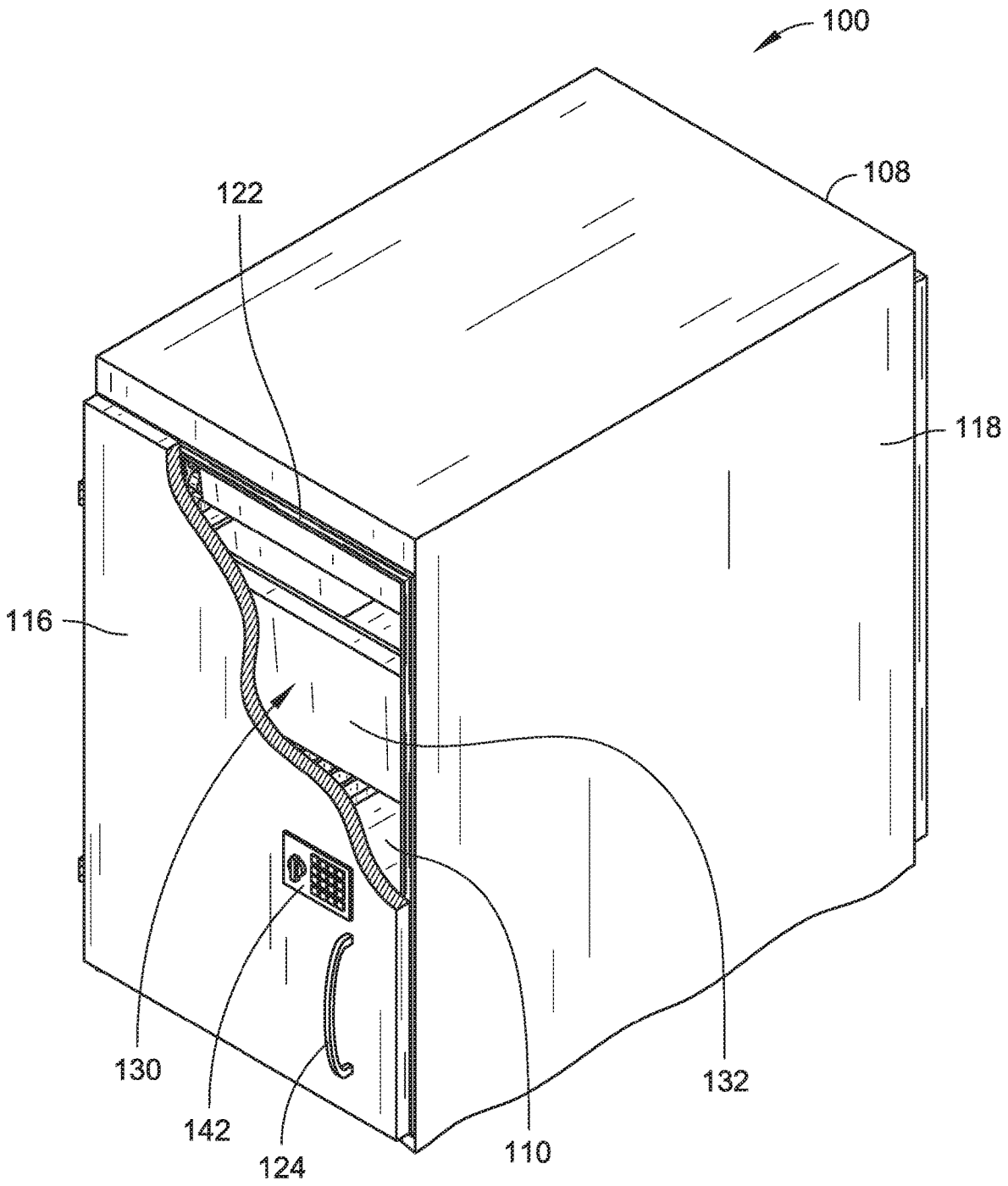
FIG. 8 is a partial cross-sectional isometric view illustrating a cabinet, such as the cabinet illustrated in FIGS. 2 through 7, in accordance with an example embodiment of the present disclosure.
Figure 9:
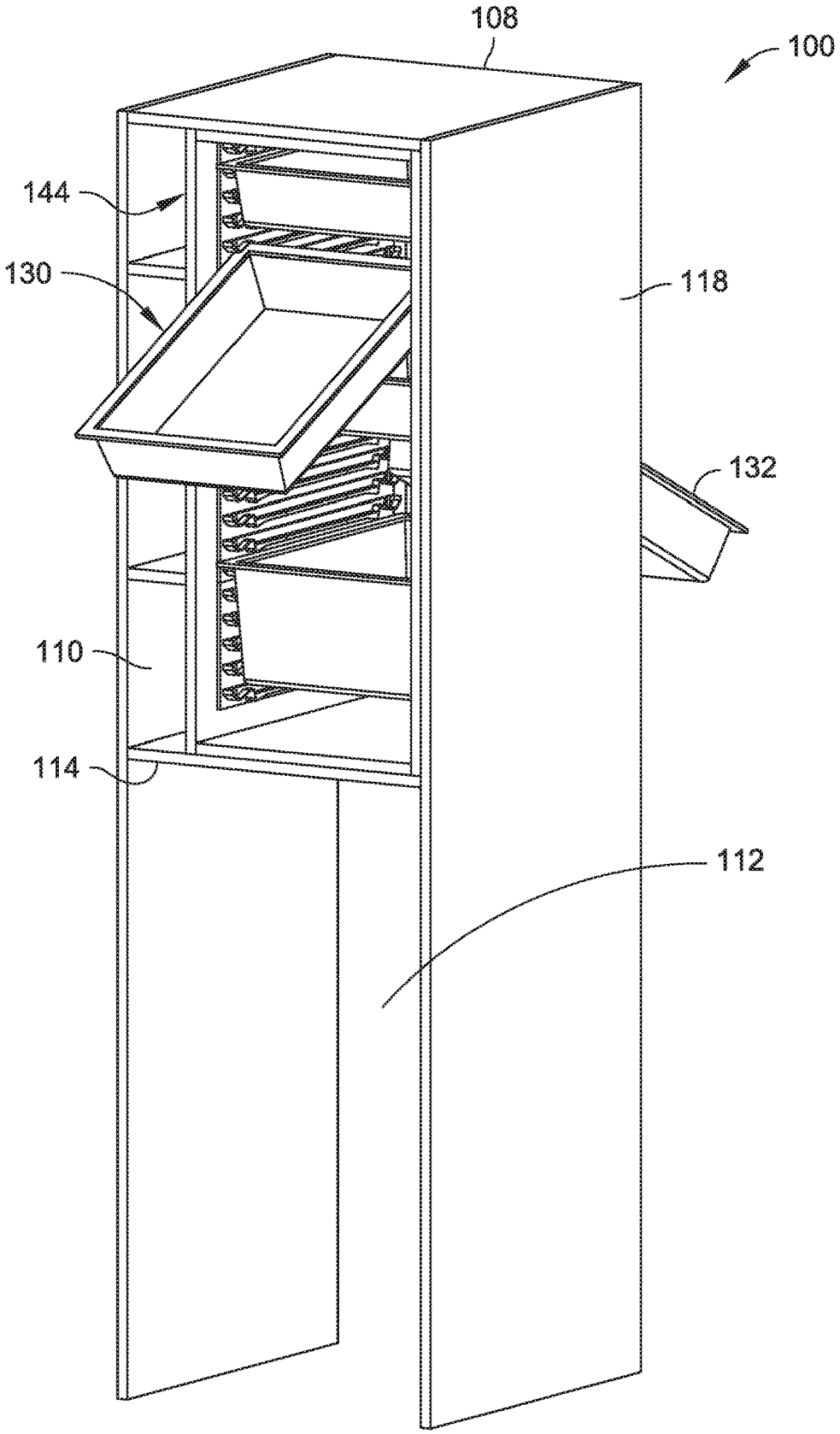
FIG. 9 is a perspective view illustrating a cabinet assembly including a base cabinet housing and a cabinet insert in accordance with an example embodiment of the present disclosure.
Figure 10:
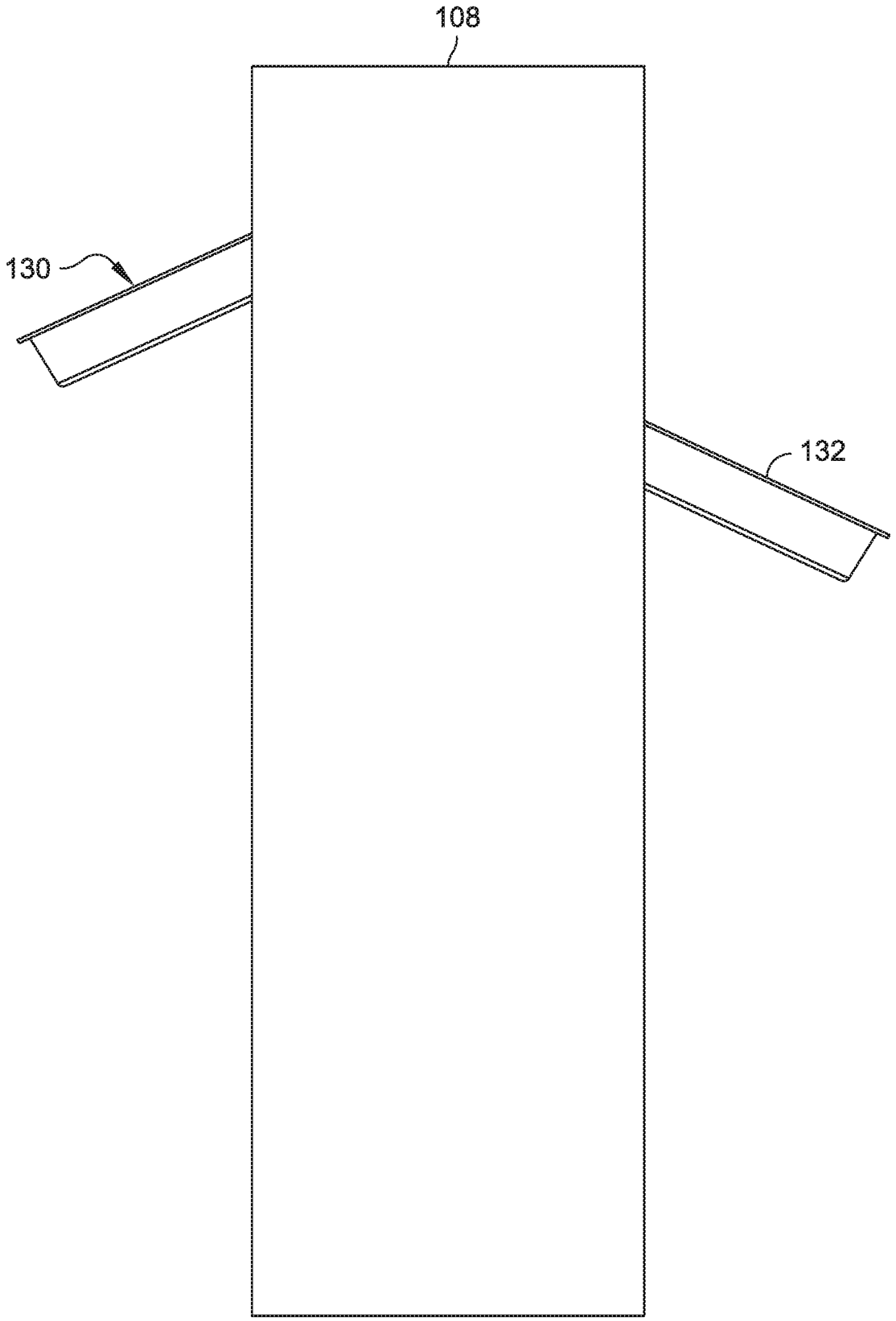
FIG. 10 is a side elevation view of the cabinet assembly illustrated in FIG. 9.
Figure 11:
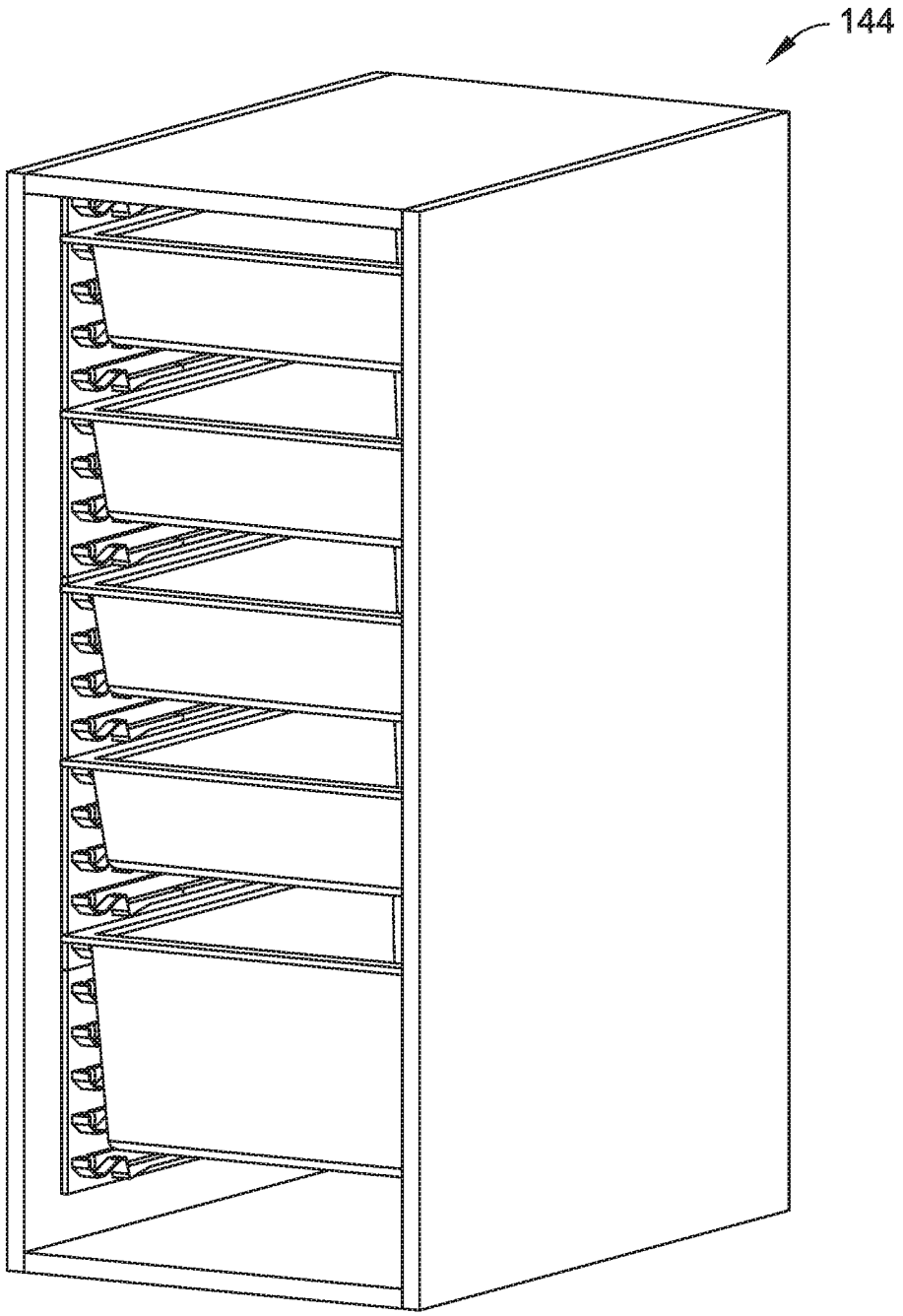
FIG. 11 is a perspective view of the cabinet insert for the cabinet assembly illustrated in FIG. 9.
Figure 12:
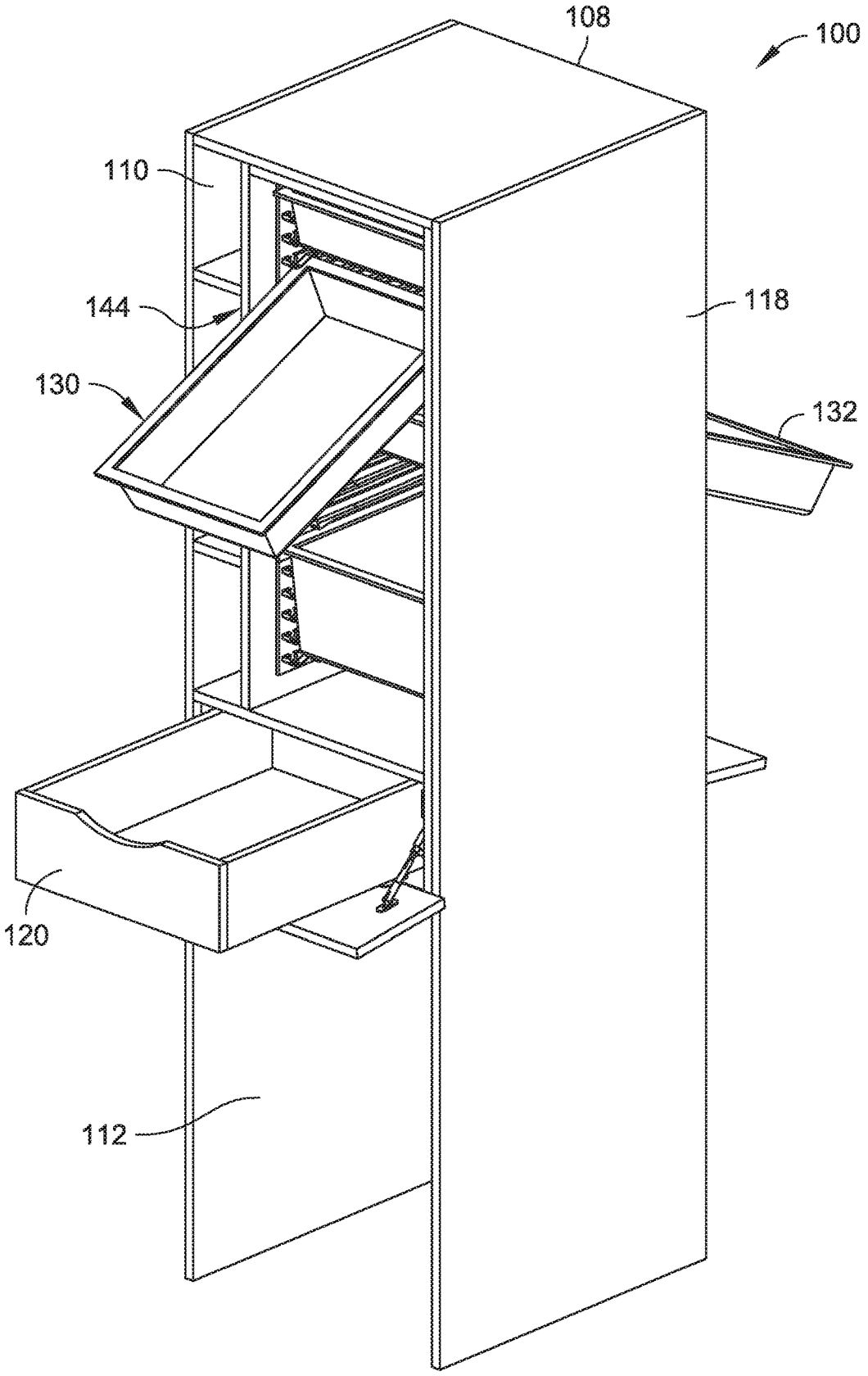
FIG. 12 is a perspective view of another cabinet assembly including a base cabinet housing and a cabinet insert in accordance with an example embodiment of the present disclosure.
Figure 13:
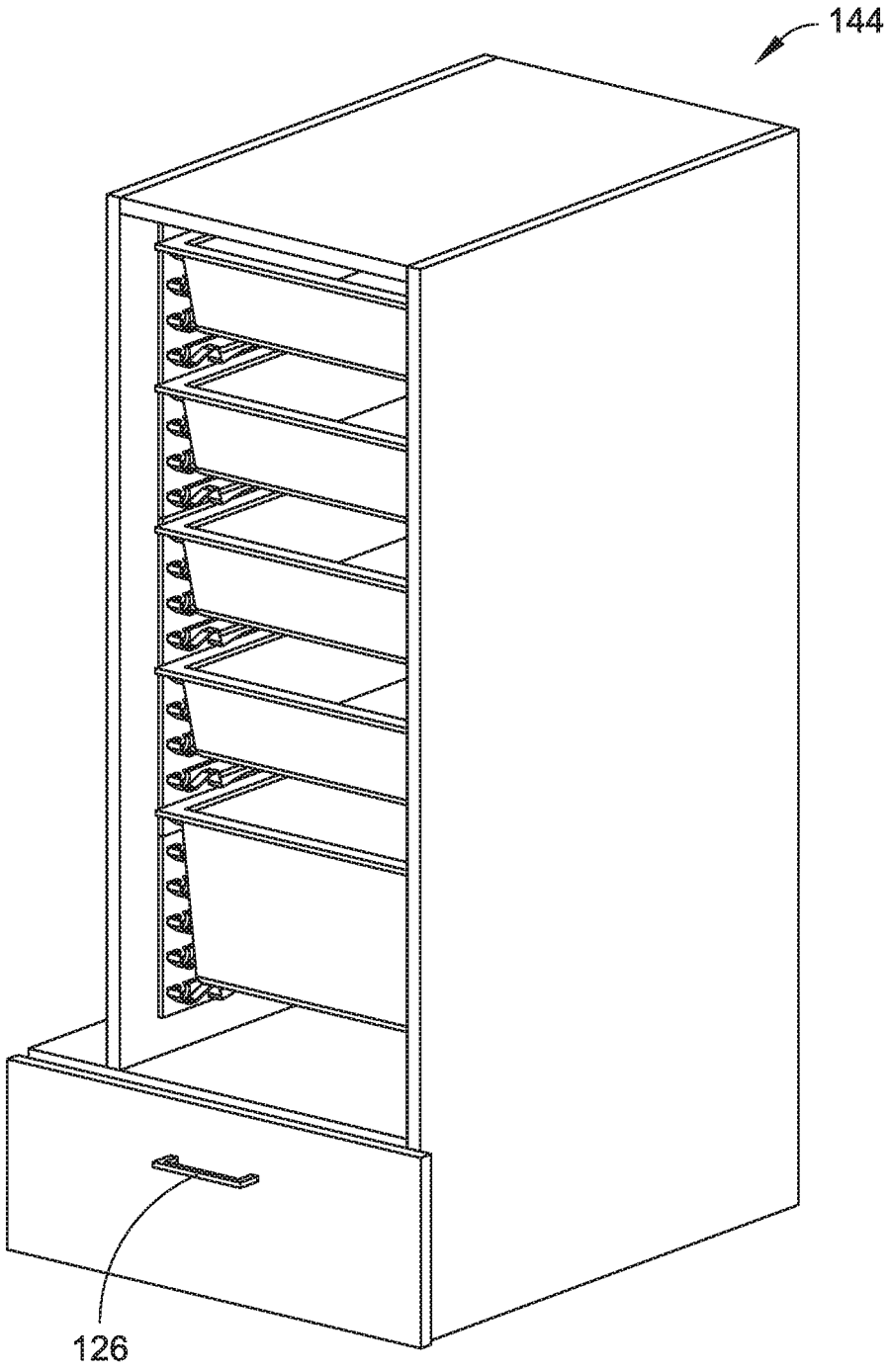
FIG. 13 is a perspective view of the cabinet insert for the cabinet assembly illustrated in FIG. 12.
Figure 14:
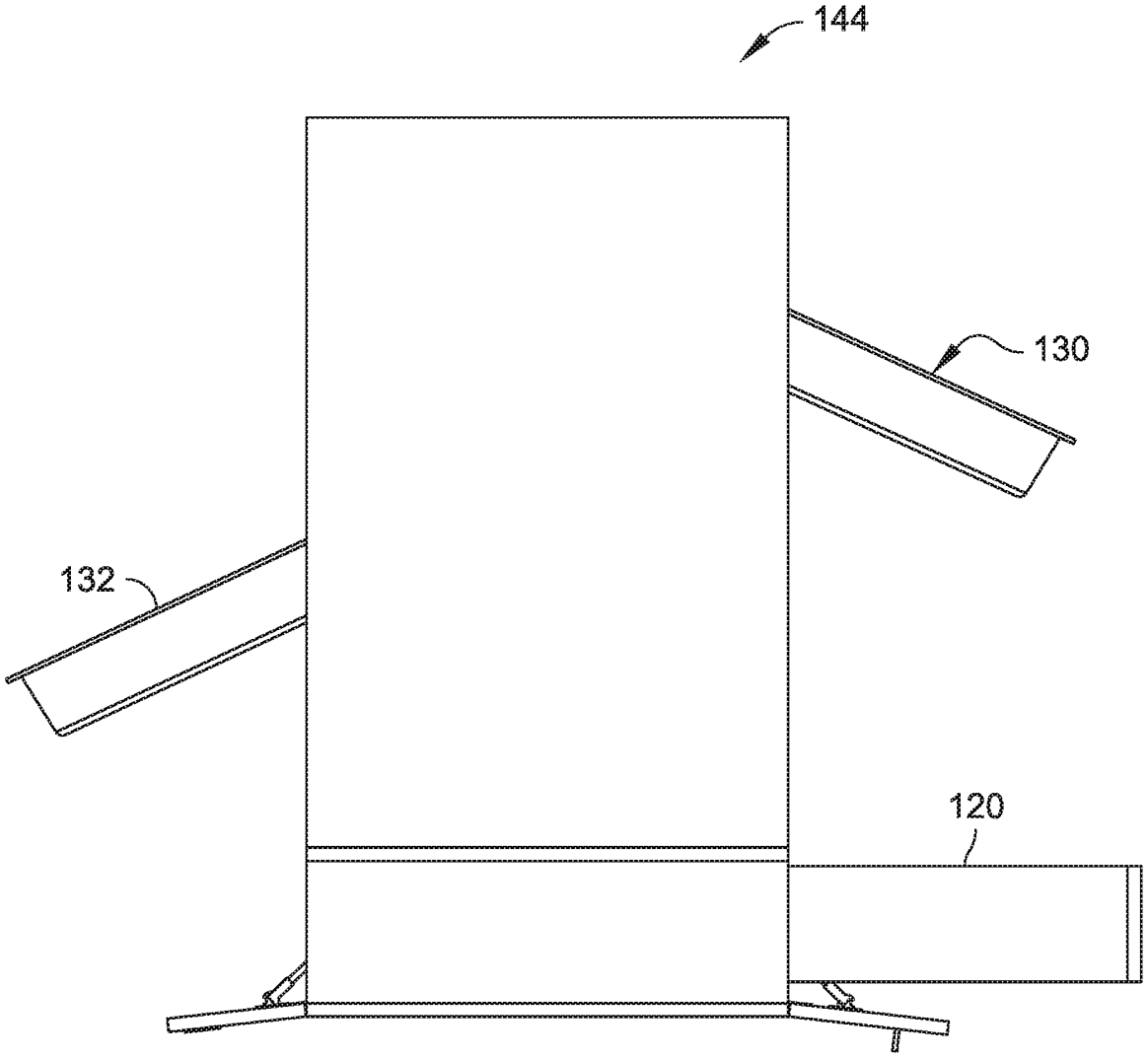
FIG. 14 is a side elevation view of the cabinet insert for the cabinet assembly illustrated in FIG. 12.
Figure 15:
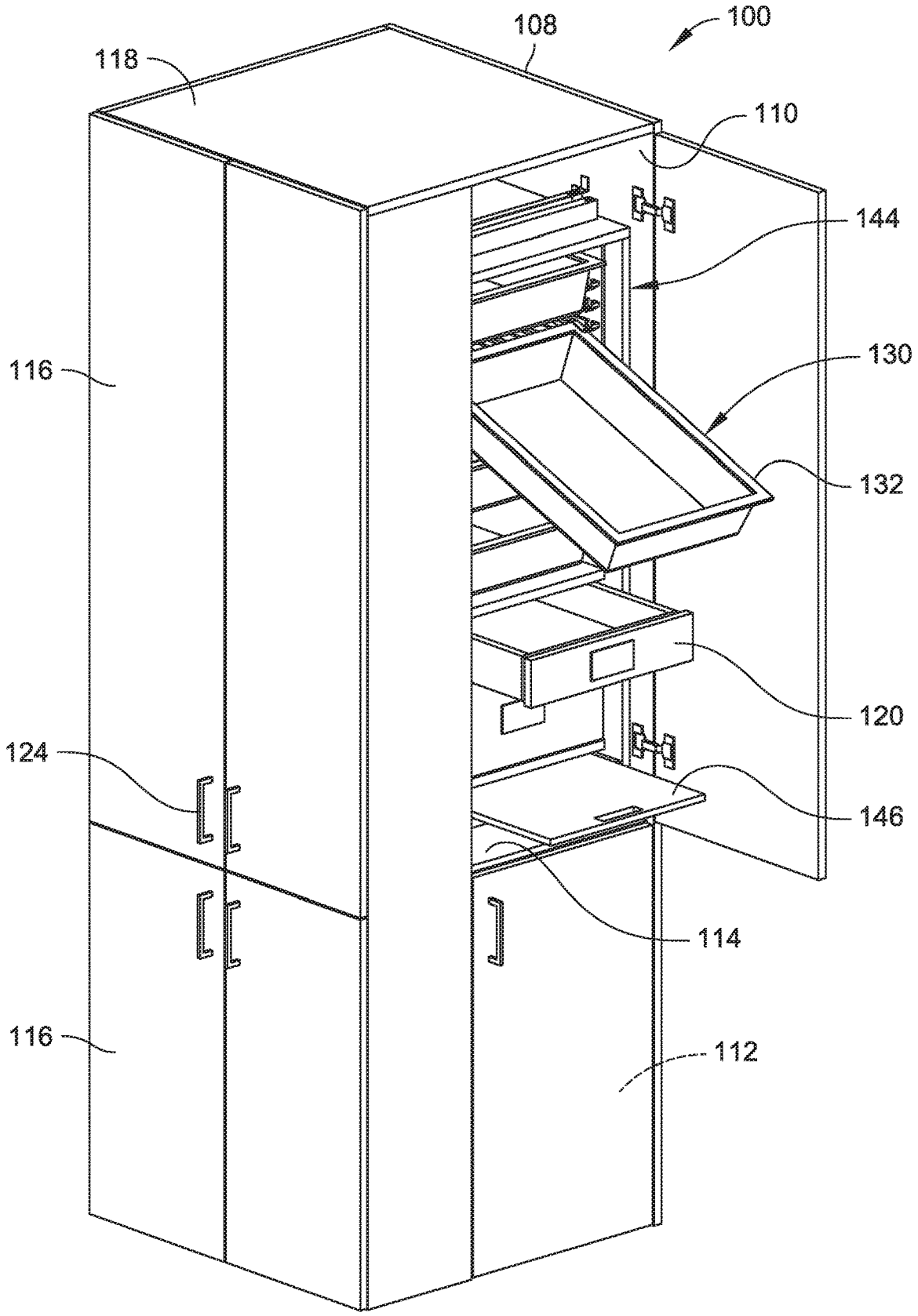
FIG. 15 is a perspective view illustrating a cabinet assembly including a base cabinet housing and a pull-out cabinet insert, where the pull-out cabinet insert is extendable from the base cabinet housing by a slide out support mechanism, and a cable management device is used to route cables to the pull-out cabinet insert in accordance with example embodiments of the present disclosure.
Figure 16:
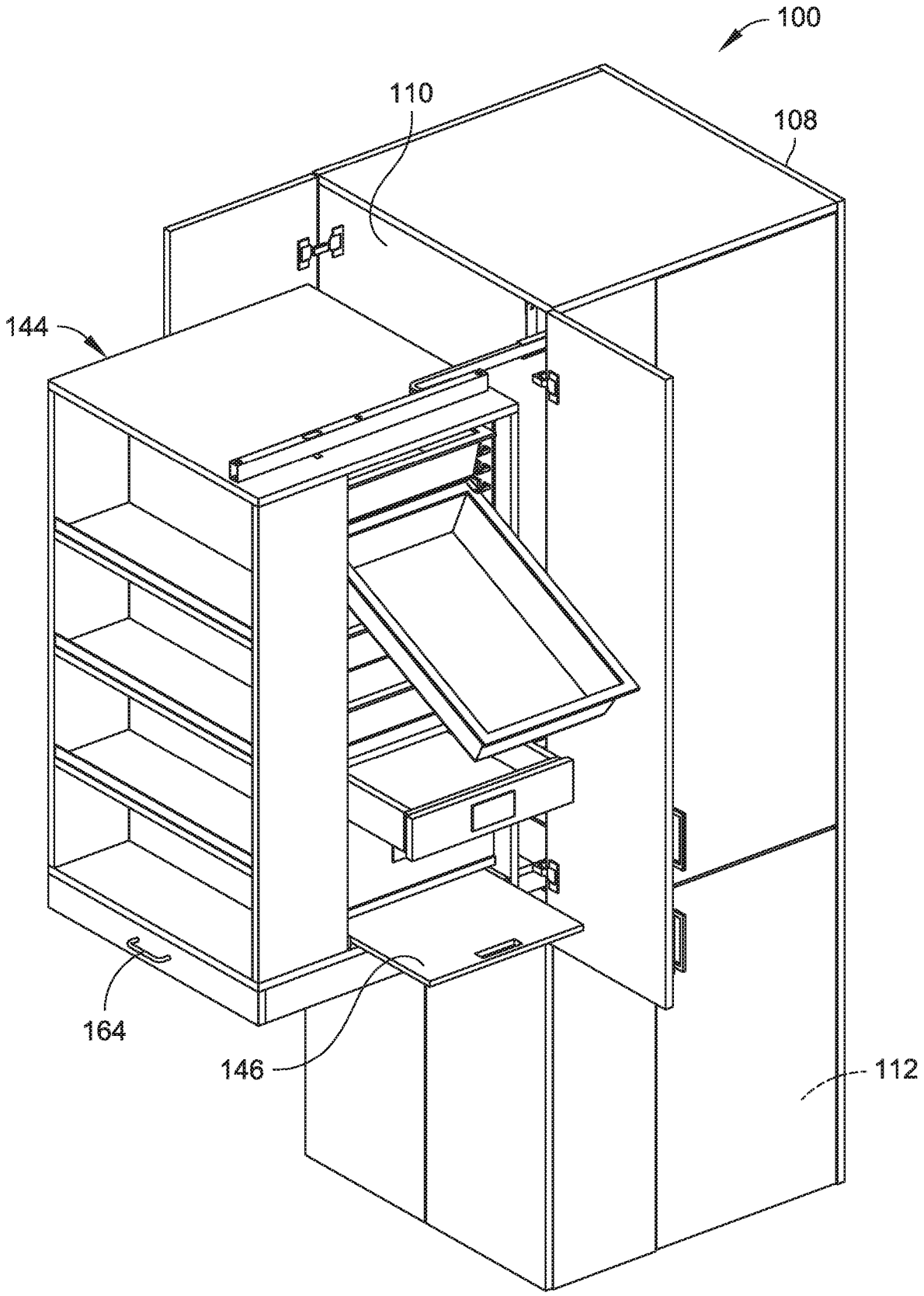
FIG. 16 is a perspective view of the cabinet assembly illustrated in FIG. 15, where the pull-out cabinet insert is shown extended from the base cabinet housing.
Figure 17:
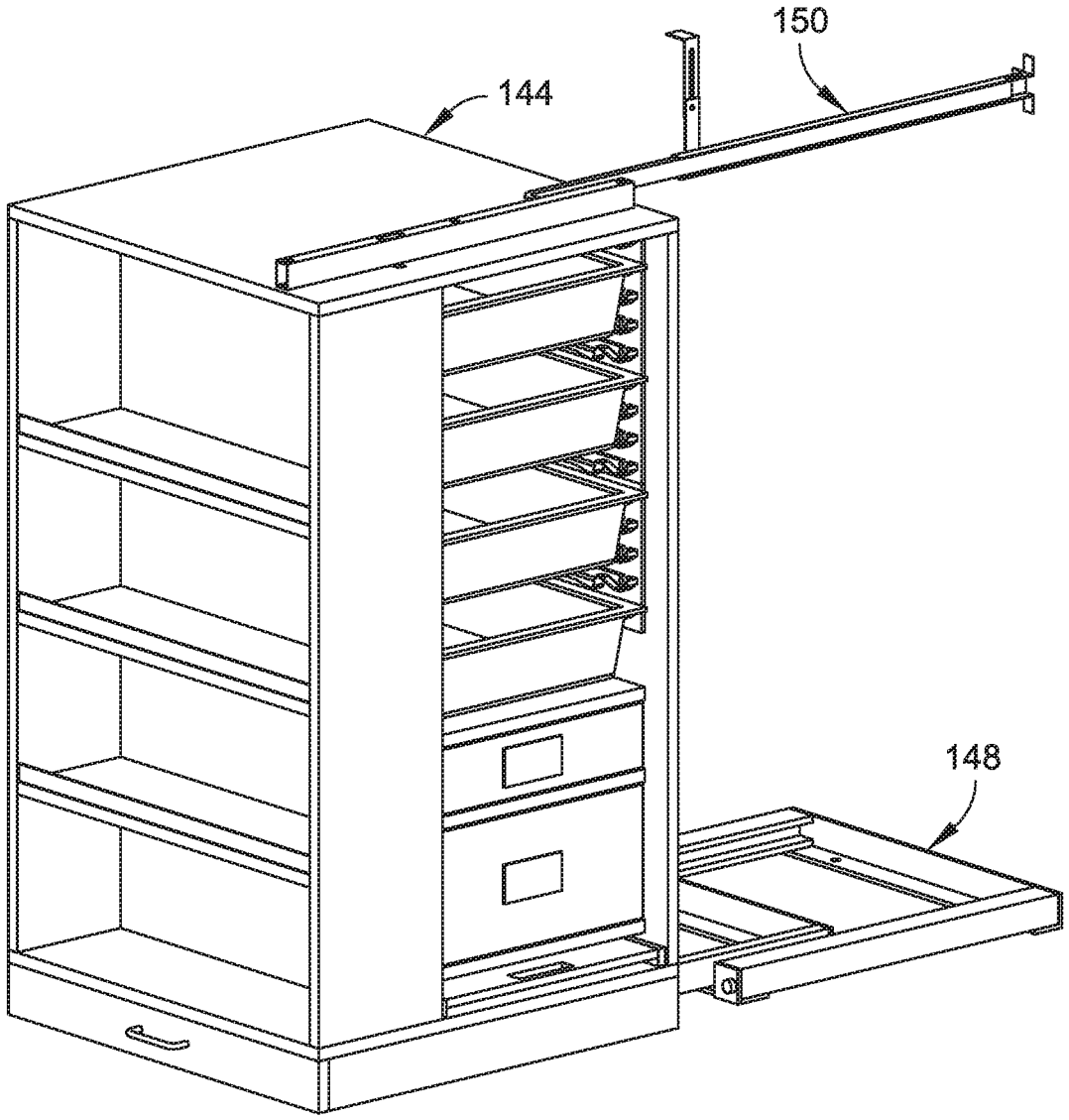
FIG. 17 is a perspective view of the pull-out cabinet insert, the slide out support mechanism, and the cable management device illustrated in FIG. 15.
Figure 18:
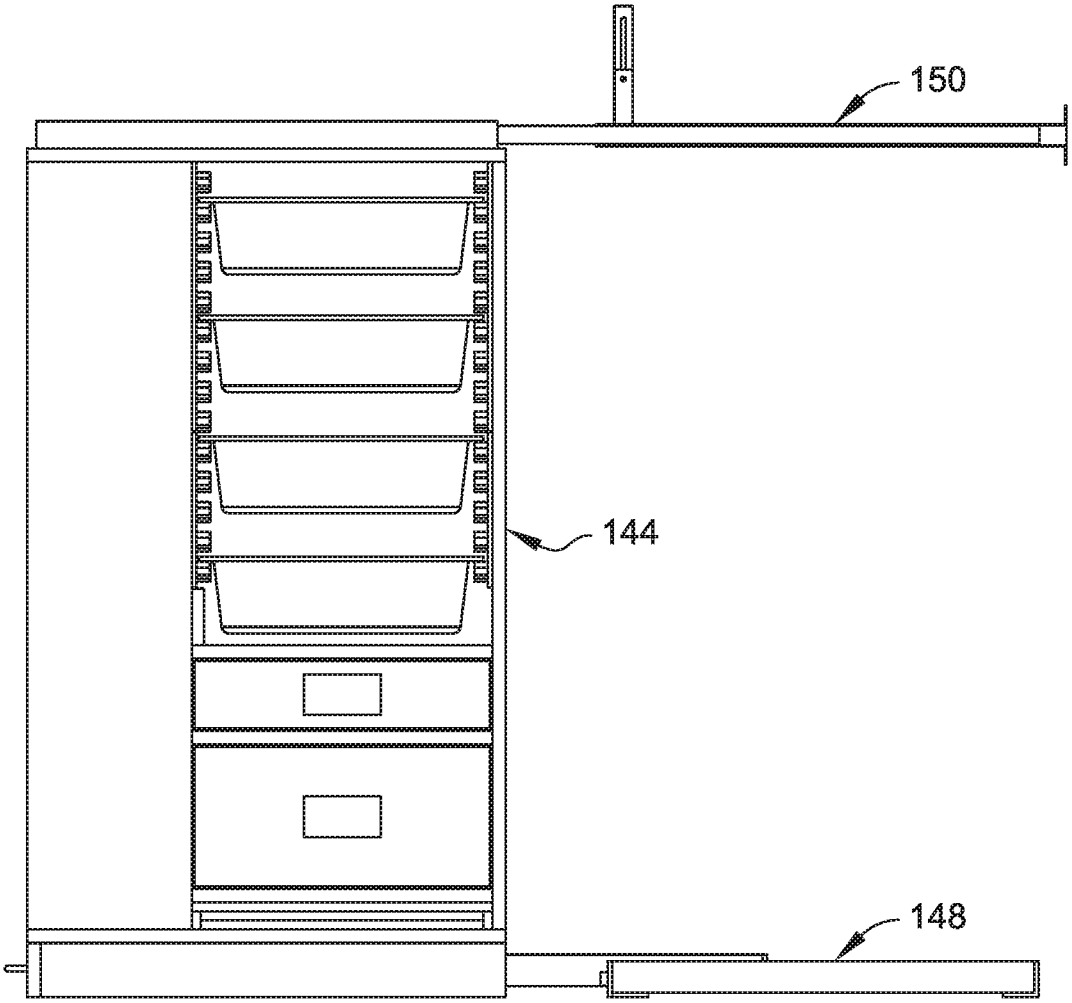
FIG. 18 is a side elevation view of the pull-out cabinet insert, the slide out support mechanism, and the cable management device illustrated in FIG. 15.
Figure 19:
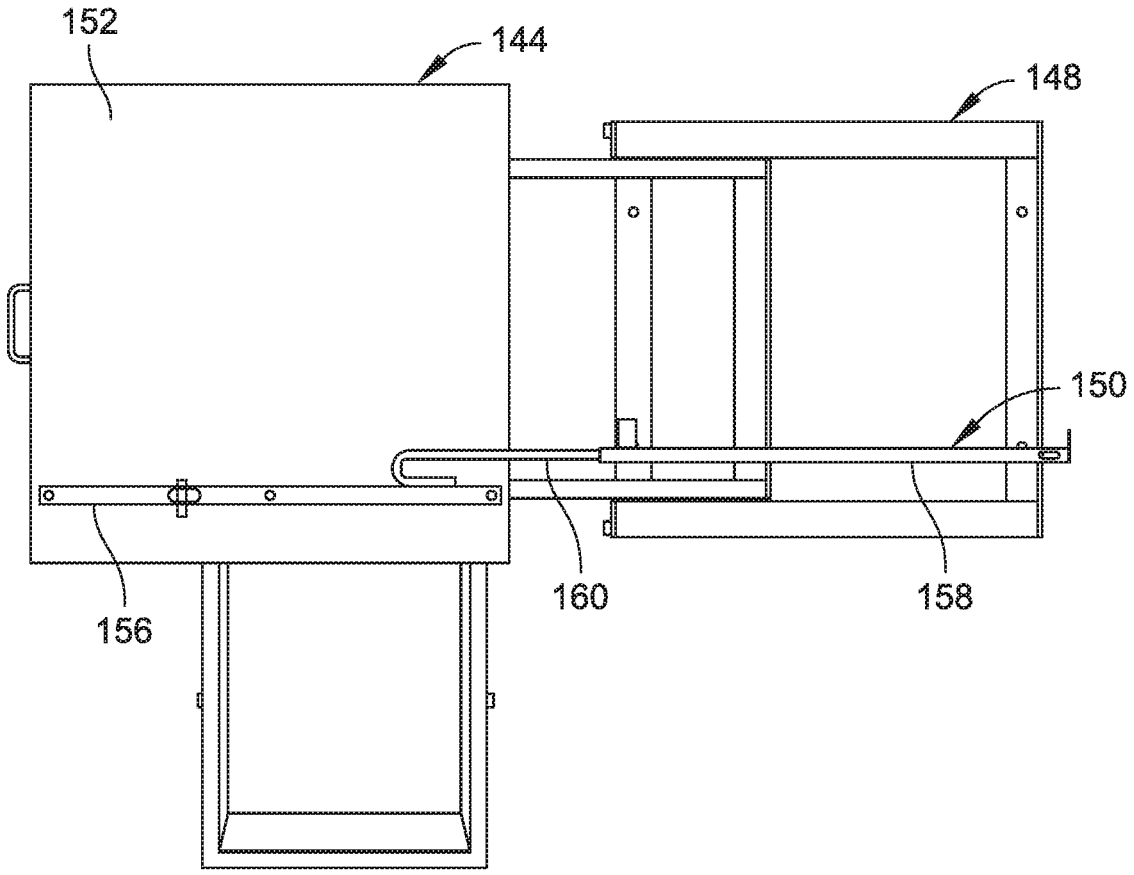
FIG. 19 is a top plan view of the pull-out cabinet insert, the slide out support mechanism, and the cable management device illustrated in FIG. 15.
Figure 20:
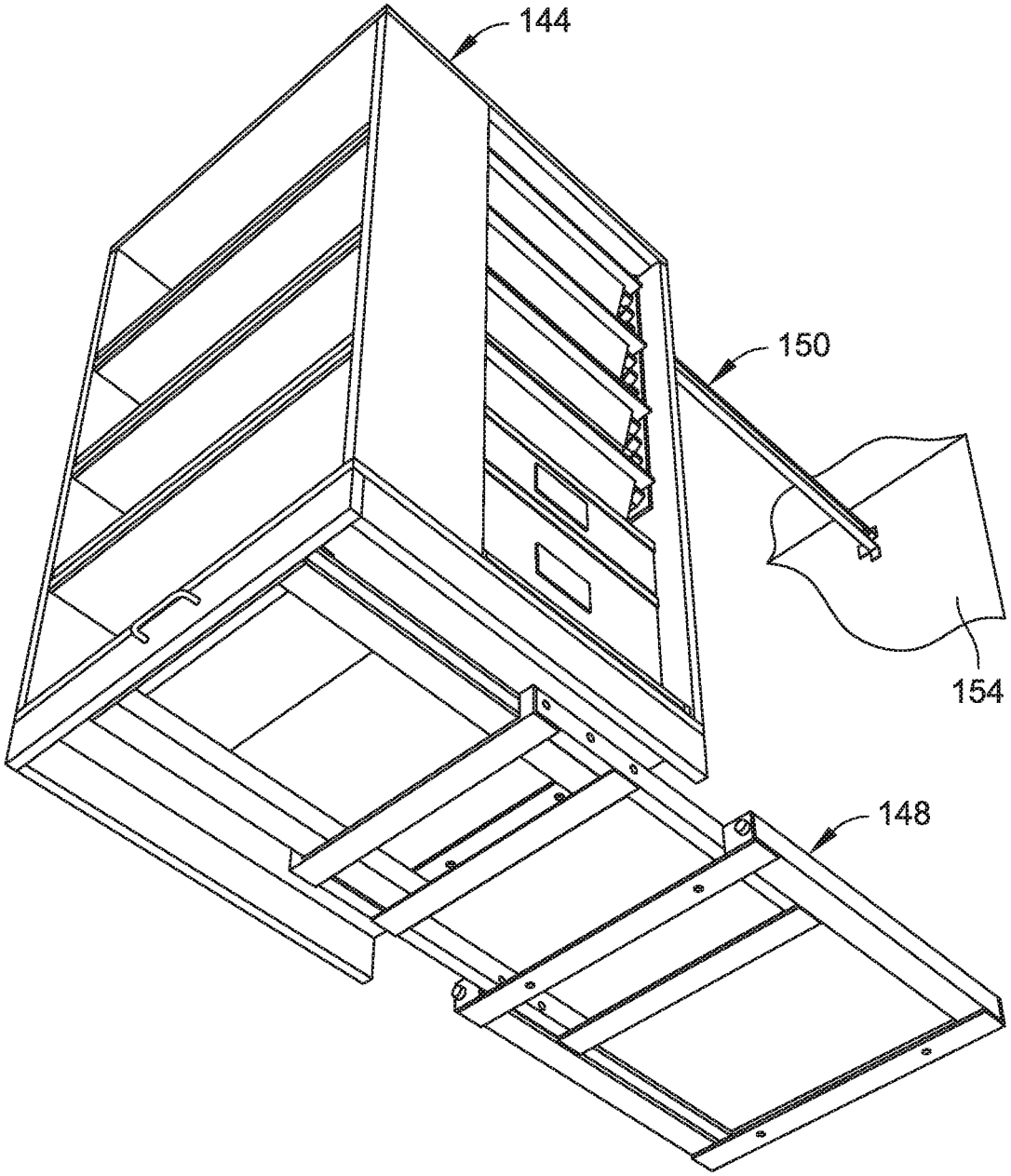
FIG. 20 is a perspective view of the pull-out cabinet insert, the slide out support mechanism, and the cable management device illustrated in FIG. 15.
Figure 21:
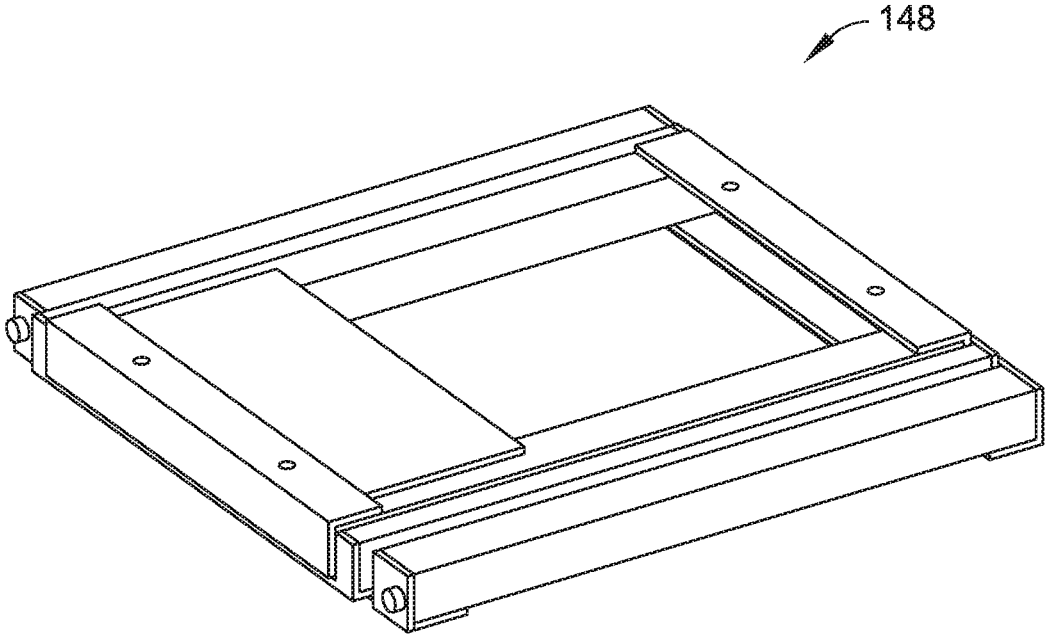
FIG. 21 is a perspective view of the slide out support mechanism illustrated in FIG. 15.
Figure 22:
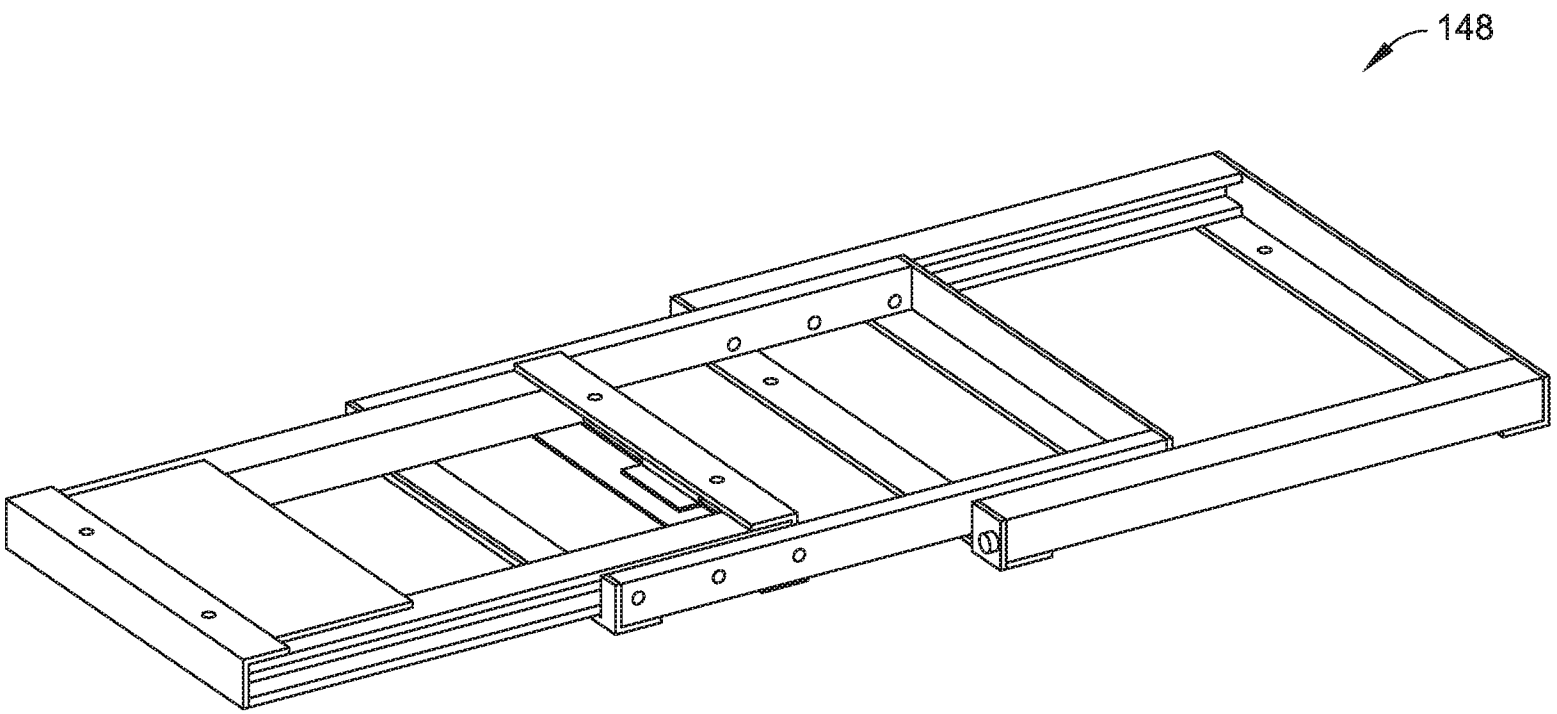
FIG. 22 is a perspective view of the slide out support mechanism illustrated in FIG. 15, where the slide out support mechanism is shown in an extended orientation.
Figure 23:
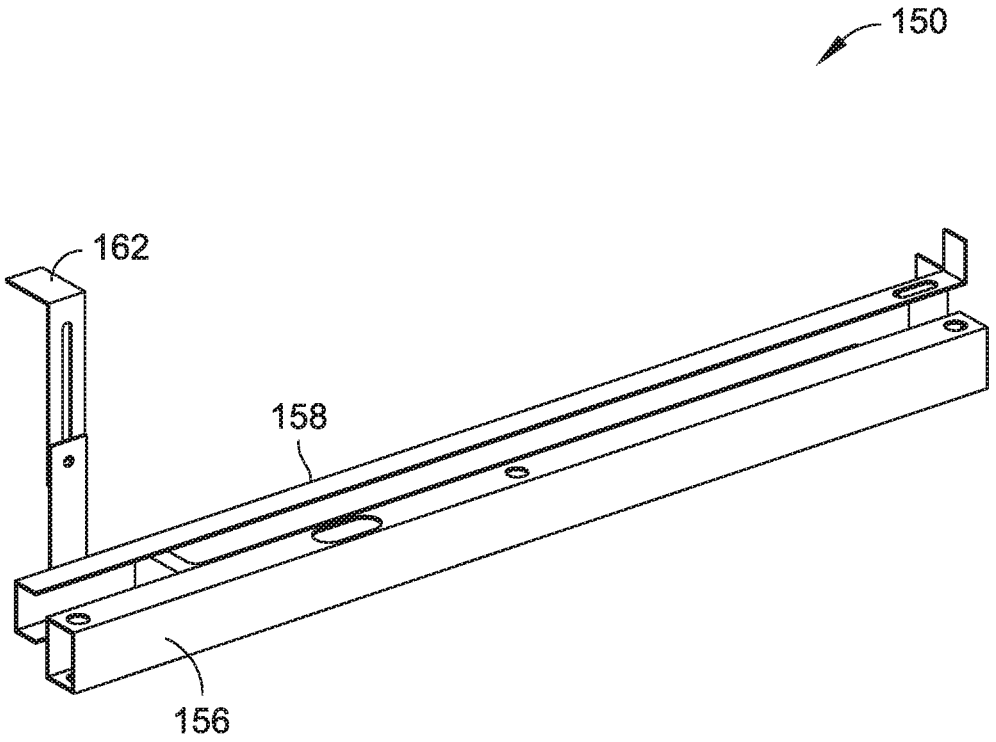
FIG. 23 is a perspective view of the cable management device illustrated in FIG. 15.
Figure 24:
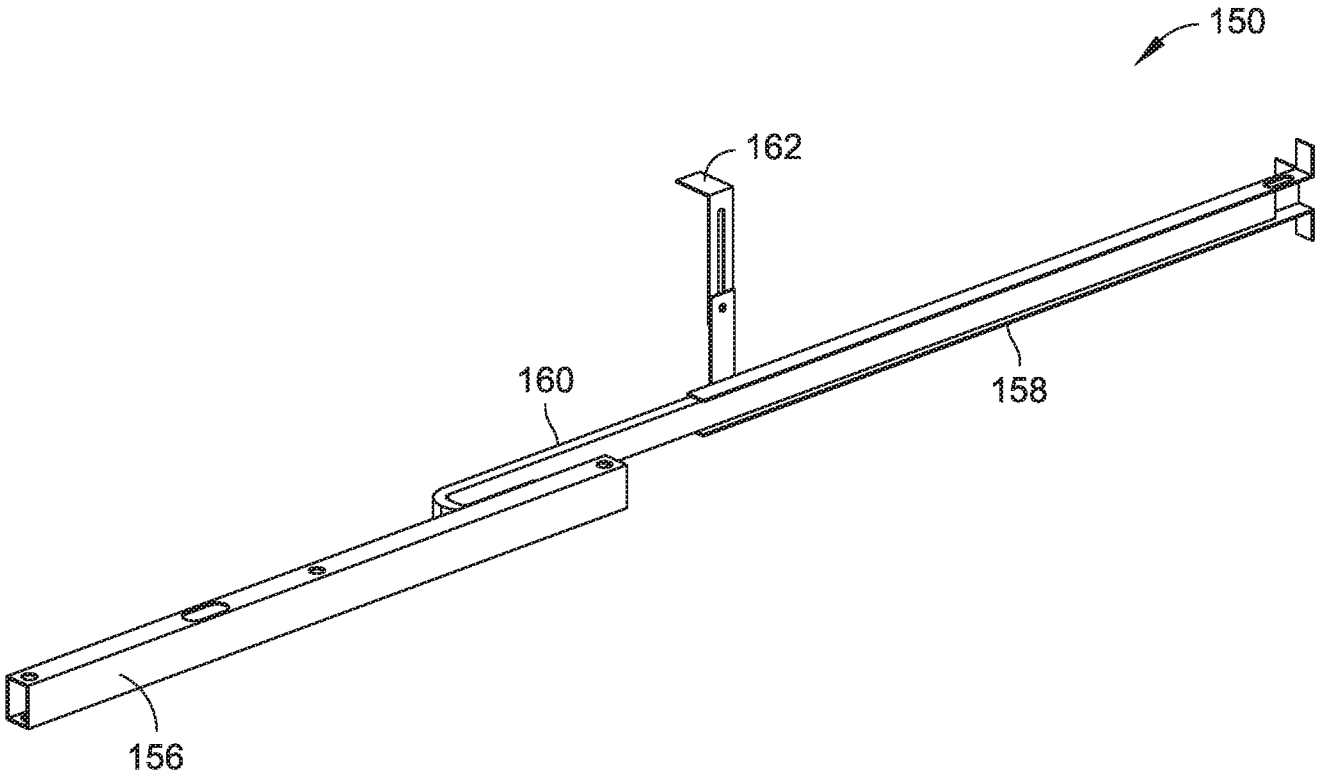
FIG. 24 is a perspective view of the cable management device illustrated in FIG. 15, where the cable management device is shown in an extended orientation.

With reference to FIG. 8, a cabinet 100 can include a gasket 122 (e.g., a closed cell rubber gasket) on one or more openings to impede smoke, dust, and/or noise from entering a room 102. In some embodiments, the gasket 122 may be used for smoke and/or draft control and acceptance. For example, a thin linear aluminum profile with ninety degree (90°) stamped corners and intersecting directional clips may be used. The linear profile may be glued and/or screwed to the linear cabinet edges. Directional clips may be used in the corners, and intersecting clips may be used where a change of direction is desired, such as around drawers and/or doors. The profiles and clips may use a track for receiving a vinyl rubber round gasket rod pressed into the track, which creates an impediment (e.g., a seal) around the doors and/or drawers to smoke and/or dust infiltration when a cabinet door is in a closed orientation.

In embodiments, the cabinet housing 108, one or more doors 116, and/or one or more drawers 120 can be formed from a material that does not promote the growth of microorganisms or is not conducive to the growth of microorganisms (e.g., a high-pressure laminate material or treated high-pressure laminate material). In some embodiments, the cabinet housing 108, one or more doors 116, and/or one or more drawers 120 can be finished with a coating (e.g., paint) that includes one or more anti-microbial additives. For example, surfaces of a cabinet 100 can be finished with a silver and/or copper containing additive that covers the cabinet box (e.g., inside and/or outside) and possibly the cabinet hardware (e.g., door handles 124, drawer handles 126, etc.). In some embodiments, silver and/or copper particles in the additive can be between about one (1) and five (5) microns in size. In some embodiments, a zeolite carrier (e.g., cuboid ceramic blocks) can be used to provide one or more active ingredients, such as ionic silver. However, this anti-microbial material is provided by way of example and is not meant to limit the present disclosure. In other embodiments, one or more surfaces of a cabinet 100 can be finished with another anti-microbial coating. Further, a cabinet 100 may be finished in various anti-microbial coatings having various colors. In some embodiments, a cabinet 100 can include a toe-kick 128, such as a stainless steel levelable toe-kick. The toe-kick 128 may be a modular recessed toe-kick, which can be coated in an anti-microbial coating. In some embodiments, a toe-kick 128 can allow for one and one-half inches (1.5") of adjustment and/or leveling.

In embodiments of the disclosure, the first interior space 110 is configured to support a basket assembly 130. For example, the first interior space 110 supports a pull-out basket assembly 130 including multiple baskets 132 stacked on top of one another. In some embodiments, the baskets 132 can be bi-directional pull-out baskets (e.g., between about two inches (2") and twelve inches (12") in height) with adjustable modular dividers inside of each basket 132. For instance, a basket 132 can be about two inches (2") high, about four inches (4") high, about eight inches (8") high, about eleven inches (11") high, and so on. The modular design of the cabinet 100 and baskets 132 can facilitate custom configuration and/or sizing. In some embodiments, the pull-out baskets 132 can be tilted for easy viewing and/or can be taken out and exchanged for clean or fully stocked trays (e.g., after an occupant is discharged from a patient room). One or more baskets 132 can be labeled with the contents thereof on each side of a basket 132. This arrangement can facilitate a nurse server exchange system for supply management and restocking by, for instance, a central supply department, hospital logistics, and so forth.

In some embodiments, the first interior space 110 can be provided by a cabinet insert 144 with dual directional extending components (e.g., as described with reference to FIGS. 9 through 20). For example, a cabinet assembly may include a base cabinet housing 108 with a cabinet insert 144 inserted into (e.g., fixedly connected to) the base cabinet housing 108. However, the cabinet insert 144 may also be provided for insertion into an existing cabinetry space, such as an in-wall cabinet space that provides dual directional access into the cabinet (e.g., access from a patient room 102, as well as access from a hallway). The cabinet insert 144 can be a box-like structure having open ends on two sides, where the insert 144 supports a pull-out basket assembly, such as the pull-out basket assembly 130 that includes multiple baskets 132 stacked on top of one another. As described, the baskets 132 can be bi-directional pull-out baskets (e.g., between about two inches (2") and twelve inches (12") in height) with adjustable modular dividers inside of each basket 132. For instance, a basket 132 can be about two inches (2") high, about four inches (4") high, about eight inches (8") high, about eleven inches (11") high, and so on. Further, a cabinet insert 144 may include a bi-directional pull-out locking medication drawer 120, an extendable writing surface 146, and so forth. The modular design of the cabinet insert 144 and baskets 132 can facilitate custom configuration and/or sizing. This arrangement can also facilitate an exchange system for supply management and restocking by, for instance, a central supply department, hospital logistics, and so forth, either from a patient room 102 or from a hallway. In some embodiments, the cabinet insert 144 can be fixedly attached (e.g., glued, bolted, screwed) to the existing cabinetry space (e.g., to one or more interior cabinet walls of an in-wall cabinet). In some embodiments, the cabinet insert 144 may be removable and replaceable with a differently configured insert.

In embodiments of the disclosure, one or more interior components can fully extend in both directions (e.g., to corridor and/or to patient room sides). For instance, a tray can extend about twenty inches (20") from the cabinet 100. In some embodiments, the first interior space 110 can also support one or more shelves, such as pull-out linen shelves (e.g., for clean linen supply). One or more shelves can be fixed, adjustable in height and so forth. Further, a space of about three inches (3") in height can be provided below the first interior space 110 (e.g., for chart storage or the like). The first interior space 110 may also include the pull-out writing surface 146.

The second interior space 112 can be configured to support a hamper assembly 134. For example, a hamper assembly 134 includes a hanging hamper bag 136 for storing soiled linen. The hamper assembly 134 can be supported in, for instance, a lower half of the cabinet 100, which can be sealed off from the rest of the cabinet 100 (e.g., from an upper half of the cabinet 100). The hamper bag 136 can be stored in a two-way heavy duty hamper compartment that accommodates a hanging hamper bag that can be collected on a hallway side by a housekeeping department and replaced with a clean bag. In some embodiments, the second interior space 112 can also include one or more shelves, which can be fixed, adjustable in height and so forth. In some embodiments, the second interior space 112 can be open, e.g., to the level of the floor or other surface supporting the cabinet, as described with reference to FIGS. 9, 10, and 12, and a cart may be stored in the second interior space 112 (e.g., a laundry hamper cart). For instance, a cart may be pushed into the second interior space 112. Further, the second interior space 112 can be vented through an air space between a wall and the side of the cabinet 100. For example, the housing 108 defines a vent 138 to the second interior space 112. In some embodiments, the second interior space 112 is not necessarily used for soiled linen. For example, the second interior space 112 can be configured to include a pull-out basket assembly (e.g., as described with reference to the first interior space 110 and the basket assembly 130), one or more shelves, and so forth.

In embodiments of the disclosure, a cabinet 100 includes one or more doors 116 providing access to the first interior space 110 or the second interior space 112. For example, an upper door 116 provides access to the first interior space 110 and a lower door 116 provides access to the second interior space 112. Further, in a two-sided configuration, separated doors 116 can be provided on both sides of the cabinet 100 (e.g., on corridor and patient room sides). In some embodiments, a door 116 can be mounted on self-closing hinges.

In some embodiments, the housing 108 also defines a third interior space 140 between the first interior space 110 and the second interior space 112. The third interior space 140 can be separated from the second interior space 112 by the sealed partition 114. The third interior space 140 may also be separated from the first interior space 110 by a sealed partition (e.g., industrial grade particle board edged with PVC edge band and sealed with healthcare grade silicone caulk as previously described). In some embodiments, the third interior space 140 can be provided by a cabinet insert 144 (e.g., as previously described). The third interior space 140 can be a medication (e.g., narcotics) compartment with locked doors on one or both sides within a clean area. The medication compartment can be between about six inches (6") and about twelve inches (12") in height (e.g., about seven inches (7") high or about eleven inches (11") high). In some embodiments, a key to the medication compartment may be removed in a locked position only. The medication compartment can include, for example, a bi-directional pull-out locking medication drawer 120. Locks 142 can be provided using one or more locking technologies, including, but not necessarily limited to: keyed, digital keypads, radio frequency identification (RFID), and so forth. For example, a staff member (e.g., a nurse) may swipe an identification (ID) badge with an RFID chip to lock and/or unlock a medication drawer. An RFID locking mechanism can also be connected to an electronic database, which can be used to log and/or track personnel who have accessed a cabinet 100.

With reference to FIG. 8, in some embodiments, a lock 142 (e.g., as previously described) may also be provided on a door 116 to the first interior space 110. In some embodiments, an RFID lock on a door and/or a medication drawer can be accessed using a wearable device, such as an RFID wristband. It should be noted that individual users and/or groups of users may be given different access to the various spaces within a cabinet 100. For example, one staff member (e.g., supply department personnel) may have access to only the first interior space 110 while another staff member (e.g., a nurse) may have access to the first interior space 110 and the medication drawer. Further, a user's level of access and/or security authorization may be indicated by specific colors for the wearable device. In some embodiments, a lock 142 may be implemented as a factory installed, plug and play access/control-type lock that can interface with existing building and/or facility systems. For example, a lock 142 may be compatible with an existing hospital facility security system, and may allow access to hospital staff (e.g., a nurse) when used with hospital-issued identification, including, but not necessarily limited to: a smart card, a smart tag, a smart key fob, a smart identification badge, and so forth.

Referring now to FIGS. 15 through 24, in some embodiments, a cabinet assembly may be configured to include a base cabinet housing 108 with a pull-out cabinet insert 144 that can extend from the base cabinet housing 108. In some embodiments, a pull-out cabinet insert 144 can be positioned in the first interior space 110 of the cabinet 100. In some embodiments, a pull-out cabinet insert 144 may also be positioned in the second interior space 112 of the cabinet 100. A pull-out cabinet insert 144 may include one or more drawers (e.g., configured as a drawer 120 with a drawer handle 126), a basket assembly 130 (e.g., including multiple baskets 132), and so forth. The pull-out cabinet insert 144 may also include one or more handles 164 for pulling the insert out from the interior of the base cabinet housing 108. Further, the pull-out cabinet insert 144 can include one or more locks (e.g., configured as a lock 142 described with reference to FIGS. 1 through 8) for controlling access to the interior of the pull-out cabinet insert 144 and/or to spaces within the various components of the pull-out cabinet insert 144, such as the drawer 120, the baskets 132, and so forth.

In embodiments of the disclosure, the pull-out cabinet insert 144 may be extended from the base cabinet housing 108 in a first direction (e.g., perpendicularly and into a hallway) and one or more components of the pull-out cabinet insert 144 (e.g., a drawer 120, a basket 132, and so forth) may extend in a direction generally perpendicular to the extension of the pull-out cabinet insert 144 (e.g., parallel to and along/down the hallway). Further, one or more of the components of the pull-out cabinet insert 144 (e.g., trays, drawers, baskets) may be extendable in one or more directions (e.g., extending on one side and/or on both sides of the pull-out cabinet insert 144). In some embodiments, the pull-out cabinet insert 144 may extend in one or more directions from the base cabinet housing 108 (e.g., extending into a hallway on one side and/or into a patient room on another side). In embodiments, the base cabinet housing 108 can have one door 116 positioned on a first side of the base cabinet housing 108 and configured to provide access to the pull-out cabinet insert 144 when the pull-out cabinet insert 144 is within the base cabinet housing 108 (e.g., as described with reference to FIG. 15), and another door 116 positioned on a second side of the base cabinet housing 108 and configured to open and allow the pull-out cabinet insert 144 to extend from within the base cabinet housing 108 (e.g., as described with reference to FIG. 16).

The pull-out cabinet insert 144 may be supported using several rails, which can be connected to one another and may extend the pull-out cabinet insert 144 from the base cabinet housing 108. For example, the pull-out cabinet insert 144 may be supported by two sets of rails, where each rail set can include three rails connected together and configured to slide relative to one another. One of the rails (e.g., an outside rail) of one rail set may be fixedly connected to the base cabinet housing 108, while another of the rails (e.g., an inside rail) may be fixedly connected to the pull-out cabinet insert 144. In some embodiments, two inside rails can be connected to a base for supporting the pull-out cabinet insert 144. The rails may be telescopically extended to support the pull-out cabinet insert 144 as it is extended from within the base cabinet housing 108 into a space adjacent to the base cabinet housing 108 (e.g., into a hallway and/or a patient room). In embodiments of the disclosure, the rails can have a generally rectangular cross-section and may be oriented vertically with respect to the pull-out cabinet insert 144 (e.g., with the long dimension of the rectangle oriented vertically with respect to the ground). It should be noted that while each rail set has been described with three rails, a rail set may include more (e.g., four) or fewer (e.g., two) rails.

Further, the rails may be mounted to the base cabinet housing 108 beneath the pull-out cabinet insert 144, e.g., where the pull-out cabinet insert 144 is supported on the rails and cantilevers out from the base cabinet housing 108. However, this configuration is provided by way of example and is not meant to limit the present disclosure. In other embodiments, the rails may be installed above the pull-out cabinet insert 144 (e.g., where the pull-out cabinet insert 144 hangs from the rails and is suspended from the base cabinet housing 108), to one or more sides of the pull-out cabinet insert 144, and so forth. Further, in some embodiments, rails may be placed in various combinations of locations, including, but not limited to, beneath the pull-out cabinet insert 144, to one or more sides of the pull-out cabinet insert 144, above the pull-out cabinet insert 144, and so forth (e.g., above and below the pull-out cabinet insert 144; above and to the side(s) of the pull-out cabinet insert 144; to the side(s) and below the pull-out cabinet insert 144; above, to the side(s), and below the pull-out cabinet insert 144; and so forth).

In some embodiments, the rails are configured as heavy-duty linear track rails. A track may be constructed from a light, corrosion-resistant metal material, such as aluminum. However, aluminum is provided by way of example and is not meant to limit the present disclosure. In other embodiments, the track may be constructed from another material, such as a metal material, including, but not necessarily limited to steel. In some embodiments, adjacent sections of track may be connected by a carriage, which may run in channels formed in a track. The carriage may be supported in the channels using bearings (e.g., in a cartridge), such as ball bearings. In some embodiments, the ball bearings may be recirculating bearings. In embodiments, the ball bearings may be formed of stainless steel, polymer, or another material. Further, a rail may be connected to an adjacent rail by one or more carriages for increased load capacity (e.g., two carriages, three carriages, etc.). Further, a damper may be included at one or more ends of a rail to damp or soften the travel of a carriage as it reaches the rail's end to slow its travel at the end of the rail.

Referring now to FIGS. 15 through 22, a slide out support mechanism 148 is used to support a pull-out cabinet insert 144 (e.g., having extendable trays, drawers, baskets). The slide out support mechanism 148 allows the pull-out cabinet insert 144 to be translated between an orientation within a cabinet assembly (e.g., a retracted configuration) to an orientation outside (or at least partially outside) of the cabinet assembly (e.g., an extended orientation). The slide out support mechanism may be constructed from slide rails (e.g., using 6061 aluminum or another comparatively high strength and/or comparatively low weight material, such as a steel material) and/or slide channels (e.g., using 6061 aluminum or another comparatively high strength and/or comparatively low weight material, such as a steel material).

In some embodiments, the slide out support mechanism 148 can have a weight-bearing capacity of seven hundred and fifty (750) pounds at full extension or at one hundred and twenty-five percent (125%) of its length (e.g., at seven inches (7") of overtravel). The slide out support mechanism 148 may include about ten (10) sealed cam followers and may use one-inch (1") outside diameter roller bearings. The rollers may be chrome steel. Further, each slide can include a soft-close damper, which may be magnetically engaged and/or may use fluid (e.g., gas, air) compression, allowing the pull-out cabinet insert 144 to come to a soft-close when pushed into its resting position (e.g., retracted configuration).

Referring to FIGS. 15 through 20, 23, and 24, a pantograph (e.g., a power-pantograph) or another extensible cable management device 150 can be used for cable management with a cabinet assembly that includes a pull-out cabinet insert 144 supported on a slide out support mechanism 148. For example, the pull-out cabinet insert 144 is connected to the cable management device 150, and cables (e.g., electrical wires, communication lines) are routed through and/or connected to (e.g., tied, clipped) to the cable management device 150 to manage the cables. In this manner, the cable management device 150 and its associated cable(s) allow the pull-out cabinet insert 144 to be translated between an orientation within the cabinet assembly (e.g., a retracted configuration) to an orientation outside (or at least partially outside) the cabinet assembly (e.g., an extended orientation) while remaining connected to and receiving electrical signals from, for example, external power.

In some embodiments, electrical wiring connected to the pull-out cabinet insert 144 via the power-pantograph or other cable management device 150 can be used to power one or more proximity readers and/or locks, such as an access/control-type lock for a medication drawer that can interface with existing building and/or facility systems (e.g., as previously described with reference to lock 142). Power can also be supplied to the pull-out cabinet insert 144 for electrically powering lighting (e.g., light emitting diode (LED) lighting). As shown, one end of the cable management device 150 can be mounted to a side (e.g., a top wall 152 and/or back side wall) of the pull-out cabinet insert 144, while another end of the cable management device 150 can be mounted to an inner wall of the cabinet assembly (e.g., an interior side wall 154 of the base cabinet housing 108 proximate to side of the pull-out cabinet insert 144 when in the retracted configuration).

In some embodiments, the cable management device 150 can include a first support rail 156 connected to the top wall 152 and a second support rail 158 connected to the interior side wall 154, where the first and second support rails 156 and 158 support the cables routed through and/or connected to the cable management device 150. In some embodiments, the cables can be routed through a retractable cable track or cable carrier 160 (e.g., including multiple articulating segments through which the cable is routed). In this manner, the cable management device 150 can be oriented in a retracted orientation and an extended orientation while power is still provided to the pull-out cabinet insert 144. A hanger 162 may also be used to support one or more of the rails (e.g., supporting the second support rail 158 by connecting the second support rail 158 to an interior top wall (ceiling) of the base cabinet housing 108).

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A server cabinet comprising:

a pull-out cabinet insert having opposing first and second ends and opposing first and second sides, the pull-out cabinet insert including:

a pull-out basket assembly configured to support a plurality of baskets stacked upon one another, each one of the plurality of baskets configured to extend and tilt from at least one side of the opposing first and second sides of the pull-out cabinet insert, and an electrically-powerable drawer;

a base cabinet housing having opposing first and second ends and opposing first and second sides, the base cabinet housing defining at least a first interior space and a second interior space, the first interior space configured to house the pull-out cabinet insert;

a slide out support mechanism configured to extend the pull-out cabinet insert from at least one end of the opposing first and second ends of the base cabinet housing, the plurality of baskets configured to extend from the at least one side of the opposing first and second sides of the pull-out cabinet insert at least generally perpendicular to the extension of the pull-out cabinet insert from the at least one end of the opposing first and second ends of the base cabinet housing;

an extensible cable management device connected to the pull-out cabinet insert, the extensible cable management device having:

a first support rail connected to a top wall of the pull-out cabinet insert and configured to extend with the pull-out cabinet insert from the at least one end of the opposing first and second ends of the base cabinet housing, a second support rail connected to the first support rail and to the base cabinet housing, and at least one electrical cable routed by the first support rail and the second support rail to the pull-out cabinet insert for powering the electrically-powerable drawer;

a first door positioned on a first side of the opposing first and second sides of the base cabinet housing and configured to provide access to the plurality of baskets of the pull-out cabinet insert when the pull-out cabinet insert is within the base cabinet housing; and a second door positioned on a first end of the opposing first and second ends of the base cabinet housing and configured to open and allow the pull-out cabinet insert to extend from within the base cabinet housing, the plurality of baskets configured to extend and tilt from the at least one side of the opposing first and second sides of the pull-out cabinet insert when the pull-out cabinet insert is extended from the base cabinet housing.

2. The server cabinet as recited in claim 1, wherein the plurality of baskets is bi-directionally supported within the pull-out cabinet insert.

3. The server cabinet as recited in claim 1, wherein the electrically-powerable drawer comprises a locking medication drawer.

4. A pull-out cabinet insert comprising:

a pull-out cabinet having opposing first and second ends and opposing first and second sides, the pull-out cabinet including:

a pull-out basket assembly configured to support a plurality of baskets stacked upon one another, each one of the plurality of baskets configured to extend and tilt from at least one side of the opposing first and second sides of the pull-out cabinet, and an electrically-powerable drawer;

a slide out support mechanism configured to extend the pull-out cabinet from a base cabinet housing having opposing first and second ends and opposing first and second sides, the slide out support mechanism configured to extend the pull-out cabinet from at least one end of the opposing first and second ends of the base cabinet housing, the plurality of baskets configured to extend from the pull-out cabinet at least generally perpendicular to the extension of the pull-out cabinet from the at least one end of the opposing first and second ends of the base cabinet housing; and an extensible cable management device connected to the pull-out cabinet, the extensible cable management device having:

a first support rail connected to a top wall of the pull-out cabinet and configured to extend with the pull-out cabinet from the at least one end of the opposing first and second ends of the base cabinet housing, a second support rail connected to the first support rail and configured to connect to the base cabinet housing, and at least one electrical cable routed by the first support rail and the second support rail to the pull-out cabinet for powering the electrically-powerable drawer.

5. The pull-out cabinet insert as recited in claim 4, wherein the plurality of baskets is bi-directionally supported within the pull-out cabinet.

6. The pull-out cabinet insert as recited in claim 4, further comprising a sealed interior space partitioned within the pull-out cabinet insert.

7. The pull-out cabinet insert as recited in claim 4, wherein the electrically-powerable drawer comprises a locking medication drawer.

8. A server cabinet comprising:

a pull-out cabinet insert having opposing first and second ends and opposing first and second sides, the pull-out cabinet insert including:

a pull-out basket assembly configured to support a plurality of baskets stacked upon one another, each one of the plurality of baskets configured to extend and tilt from at least one side of the opposing first and second sides of the pull-out cabinet insert, and an electrically-powerable locking medication drawer;

a base cabinet housing having opposing first and second ends and opposing first and second sides, the base cabinet housing defining at least a first interior space and a second interior space, the first interior space configured to house the pull-out cabinet insert;

a slide out support mechanism configured to extend the pull-out cabinet insert from at least one end of the opposing first and second ends of the base cabinet housing, the plurality of baskets configured to extend from the at least one side of the opposing first and second sides of the pull-out cabinet insert at least generally perpendicular to the extension of the pull-out cabinet insert from the at least one end of the opposing first and second ends of the base cabinet housing;

an extensible cable management device connected to the pull-out cabinet insert, the extensible cable management device having:

a first support rail connected to a top wall of the pull-out cabinet insert and configured to extend with the pull-out cabinet insert from the at least one end of the opposing first and second ends of the base cabinet housing, a second support rail connected to the first support rail and to the base cabinet housing, and at least one electrical cable routed by the first support rail and the second support rail to the pull-out cabinet insert for powering the electrically-powerable locking medication drawer;

a first door positioned on a first side of the opposing first and second sides of the base cabinet housing and configured to provide access to the plurality of baskets of the pull-out cabinet insert when the pull-out cabinet insert is within the base cabinet housing; and a second door positioned on a first end of the opposing first and second ends of the base cabinet housing and configured to open and allow the pull-out cabinet insert to extend from within the base cabinet housing, the plurality of baskets configured to extend and tilt from the at least one side of the opposing first and second sides of the pull-out cabinet insert when the pull-out cabinet insert is extended from the base cabinet housing.

9. The server cabinet as recited in claim 8, wherein the plurality of baskets is bi-directionally supported within the pull-out cabinet insert.

* * * * *